US011964807B2

(12) United States Patent
Lin et al.

(10) Patent No.: US 11,964,807 B2
(45) Date of Patent: Apr. 23, 2024

(54) PACKAGING WITH TAMPER-EVIDENT SEAL

(71) Applicant: Apple Inc., Cupertino, CA (US)

(72) Inventors: Amanda Y. Lin, Sunnyvale, CA (US); David Samuel Kumka, San Francisco, CA (US); Bartley K. Andre, Palo Alto, CA (US); Abidur Rahman Chowdhury, San Francisco, CA (US); Wei Dai, San Jose, CA (US); Isaac Hayes, San Jose, CA (US); Geng Luo, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 170 days.

(21) Appl. No.: 17/359,035

(22) Filed: Jun. 25, 2021

(65) Prior Publication Data

US 2022/0411150 A1 Dec. 29, 2022

(51) Int. Cl.
*B65D 5/38* (2006.01)
*B65D 5/42* (2006.01)
*B65D 55/06* (2006.01)

(52) U.S. Cl.
CPC ..... *B65D 55/06* (2013.01); *B65D 5/38* (2013.01); *B65D 5/4233* (2013.01); *B65D 2401/05* (2020.05)

(58) Field of Classification Search
CPC ..... B65D 2203/02; B65D 2401/00; B65D 33/1691; B65D 75/5855; B65D 77/2032; B65D 5/4233; B65D 5/643; B65D 55/06; B65D 2401/05; G09F 2003/0277; G09F 3/0341; B32B 38/10; B65B 61/182
(Continued)

(56) References Cited

U.S. PATENT DOCUMENTS 5,048,711 A * 9/1991 Weiss ..... B65D 55/06 215/230
5,156,331 A * 10/1992 Pirre ..... B65D 83/08 206/455

(Continued)

FOREIGN PATENT DOCUMENTS

CN 104658414 A 5/2015
GB 2493905 A 2/2013

(Continued)

*Primary Examiner* — Christopher R Demeree
*Assistant Examiner* — Phillip D Schmidt
(74) *Attorney, Agent, or Firm* — Sterne, Kessler, Goldstein & Fox P.L.L.C.

(57) ABSTRACT

Packaging may include a base box and a lid having a tamper-evident seal. The tamper-evident seal may include a paper substrate having a first adhesive portion configured to attach to a side panel of the base box, a second adhesive portion configured to attach to a second side panel of the lid. The first and second adhesive portions may be disposed on opposing sides of the paper substrate, and a tab configured to be accessible on an exterior of a package when the tamper-evident seal is applied may be a part of the paper substrate. When the tab is pulled with sufficient force, the paper substrate tears such that the first adhesive portion and the second adhesive portion remain fixed to the first and second side panels, respectively, while the remainder of the paper substrate tears free so that the packaging may be opened.

20 Claims, 17 Drawing Sheets

(58) Field of Classification Search
USPC ..... 229/102, 123.1, 123.2, 125.21, 125.37, 229/125.39, 117.26; 206/807, 308.2; 220/315; 156/250; 428/916
See application file for complete search history.

(56) References Cited

U.S. PATENT DOCUMENTS

| | | | | |
|---|---|---|---|---|
| 5,839,648 | A * | 11/1998 | Brigand | B65D 33/1691 229/87.05 |
| 10,060,461 | B2 * | 8/2018 | Korinek | F16B 11/006 |
| 10,358,264 | B1 * | 7/2019 | Bristol | B65D 21/0205 |
| 2005/0045503 | A1 * | 3/2005 | Wong | B65D 55/06 206/308.2 |
| 2014/0217163 | A1 * | 8/2014 | Marshall | B65D 5/0236 229/200 |
| 2014/0262930 | A1 | 9/2014 | Korinek et al. | |

FOREIGN PATENT DOCUMENTS

| | | | |
|---|---|---|---|
| KR | 20190040389 | A * | 4/2019 |
| KR | 20190042145 | A * | 4/2019 |
| WO | 2017023183 | A1 | 9/2017 |

* cited by examiner

PACKAGING WITH TAMPER-EVIDENT SEAL

FIELD

The described embodiments relate generally to packaging. More particularly, the present embodiments relate to packaging having a tamper-evident seal.

BACKGROUND

The described embodiments relate generally to packaging, including tamper-evident seals and packaging that uses them. More particularly, the present embodiments relate to packaging using a tamper-evident seal that may be tearable such that it is clear whether a package has been previously opened. Product packaging is an integral part of a customer's experience. It introduces the customer to their product, and can affect the customer's feelings toward the product and the company that created it. Additionally, evidence of prior tampering is important to customers and retailers, particularly for higher end packaging (e.g., for electronic devices). Certain current higher end packaging may include plastic materials or film overwraps as a tamper-evidencing device.

What is needed is a packaging paradigm that can maintain packaging integrity prior to being received by an end user and indicate prior opening of the package, but be removable and increase recyclability of the packaging.

SUMMARY

Some embodiments are directed to a tamper-evident seal for packaging. The tamper-evident seal includes a paper substrate. A first adhesive portion may be configured to attach to a side panel of a base box, and a second adhesive portion may be configured to attach to a second side panel of a lid, as part of the tamper-evident seal. The tamper-evident seal may also include a tab configured to extend to an exterior of a package when the tamper-evident seal is applied. When the tab is pulled with sufficient force, the paper substrate tears such that the first adhesive portion and the second adhesive portion remain fixed to the first and second side panels, respectively, while the remainder of the paper substrate tears free. This may allow the packaging to be opened.

In some embodiments, one of the first or second adhesive portions (or both) includes fiber tape. In some embodiments, the paper substrate does not include perforations. The paper substrate is configured to tear to create tear paths extending along the direction of the pull force. The tab is releasably attached to the base or lid when the base box and lid are in the closed configuration in some embodiments.

Some embodiments are directed to packaging. The packaging may include a base box having a first side panel, a lid including a second side panel parallel to the first side panel, and a tamper-evident seal disposed between the first and second side panels when the base box and lid are in a closed configuration. In some embodiments, the tamper-evident seal includes a paper substrate. The paper substrate may include a first portion extending in a first direction, as well as second and third portions extending in opposing directions. In this way, the first, second, and third portions together form a T-shape. In some embodiments, the first portion is folded over onto itself at a first fold. The second and third portions are each respectively folded at second and third folds around a portion of the overlap of the first portion formed by the first fold. In some embodiments, a first adhesive portion is attached to the first side panel, and a second adhesive portion is attached to the second side panel. In response to a force applied in a direction away from the packaging, the paper substrate is configured to tear such that the first portion tears free along a first and second line parallel to the folds of the second and third portions.

In some embodiments, one of the first or second adhesive portions (or both) includes or is formed from fiber tape. The first adhesive portion is attached to a surface of the first side panel that is facing the second side panel in some embodiments, and the second adhesive portion is attached to a surface of the second side panel that is facing the first side panel. In some embodiments, the base box further includes an indentation to receive a portion of the tamper-evident seal on the outside of the base box. The first portion of the paper substrate further includes a releasable adhesive to engage the indentation when the packaging is in a closed configuration in some embodiments.

In some embodiments, the paper substrate further includes a tab extending from the first portion, and the tab is releasably attached to the base or lid when the base box and lid are in the closed configuration. The paper substrate includes stress concentration features at an intersection point of the first and second and first and third portions, respectively, in some embodiments.

In some embodiments, the tamper-evident seal further includes a stiffening element fixed to the first portion of the paper substrate and configured to increase stiffness of the first portion relative to one of the second or third portions (or both). Widths of the individual portions of the paper substrate are equal in some embodiments. In some embodiments, the paper substrate further comprises a tab extending from the first portion, the tab having an increased width relative to the first portion. The width of the second and third portions are equal to each other in some embodiments.

In some embodiments, the first portion of the paper substrate further includes a releasable adhesive to engage one of the base box or the lid when packaging is in a closed configuration, prior to tearing the tamper-evident seal.

Some embodiments are directed to packaging including a base box having a first side panel and a base panel, a lid having a second side panel parallel to the first side panel and perpendicular to the base panel when the packaging is closed, and a tamper-evident seal disposed between the first and second side panels when the base box and lid are in a closed configuration. In some embodiments, the tamper-evident seal includes a paper substrate, a first adhesive coupling the paper substrate to the base panel, a second adhesive coupling the paper substrate to the second side panel, and in response to a force applied in a direction away from the packaging, the first and second adhesive is configured to peel away from their respective panels.

In some embodiments, the paper substrate does not tear during removal from the packaging. The tamper-evident seal may include a third adhesive coupling the paper substrate to the second side panel having a stronger shear strength than the second adhesive in order for the tamper-evident seal to be removed from the packaging. In some embodiments, the paper substrate is not attached to the first side panel. The paper substrate extends along the base panel, folding inward and along the first side panel, and doubles back on itself such that the second adhesive may be coupled to the second side panel in some embodiments.

Some embodiments are directed to packaging including a base box having a first side panel, a lid having a second side panel parallel to the first side panel, and a tamper-evident seal formed from a paper substrate and disposed between the first and second side panels when the base box and lid are in a closed configuration. In some embodiments, the tamper-evident seal includes a first adhesive portion attached to the first side panel, a second adhesive portion attached to the second side panel, and a tab extending to an exterior of the packaging and accessible to a user. When the tab is pulled with sufficient force, the paper substrate tears such that the first adhesive portion and the second adhesive portion remain fixed to the first and second side panels, respectively, while the remainder of the paper substrate tears free.

Some embodiments are directed to packaging including a base box including a first side panel, a lid comprising a second side panel parallel to the first side panel, and a tamper-evident seal disposed between the first and second side panels when the base box and lid are in a closed configuration. In some embodiments, the tamper-evident seal includes a paper substrate comprising. The paper substrate includes a label surface visible when the packaging is in a closed configuration, and a tab configured to be tearable in response to a force away from the packaging such that the tamper-evident seal is broken. The label surface is adhered to a bottom panel of the base box perpendicular to the first and second side panels, and a portion of the tamper evident seal disposed between the first and second side panels is adhered to an inner side of the second side panel, and is not adhered to the first side panel. In some embodiments, tearing the tab breaks the tamper-evident seal by separating the label surface from the portion of the tamper-evident seal disposed between the first and second side panels.

Some embodiments are directed to packaging including a base box including a first side panel and a base panel, a lid comprising a second side panel parallel to the first side panel and perpendicular to the base panel when the packaging is closed, and a tamper-evident seal. The tamper-evident seal may include a first paper substrate, a first adhesive coupling the first paper substrate to the base panel, a second paper substrate fixed to a portion of the first paper substrate, and a second adhesive coupling the second paper substrate to the second side panel in a first configuration. In response to a force applied to a tab portion of the tamper-evident seal in a direction away from the packaging, the first and second adhesive is configured to peel away from their respective panels, and the second adhesive is configured to transition to be disposed between the first and second paper substrates.

In some embodiments, the tamper-evident seal does not tear during removal from the packaging. The first adhesive is a splittable adhesive, whereby when the first adhesive is decoupled from the base panel, the splittable adhesive itself separates, exposing non-adhesive surfaces, in some embodiments. The splittable adhesive further may include an indication surface that is only visible once the splittable adhesive is separated, such that the opening of the tamper-evident seal is apparent.

Some embodiments are directed to a tamper-evident seal, including first and second substrates operatively coupled to each other and couplable to separate packaging components, a removable adhesive configured to adhere the tamper-evident seal to a first packaging component in a first configuration, and further configured to automatically remove from the first packaging component and reattach to one of the first and second substrates when the tamper-evident seal is removed from the packaging.

In some embodiments, one or more of the first and second substrates are made from paper. The tamper-evident seal does not tear during removal from the packaging in some embodiments. The tamper-evident seal may include a splittable adhesive configured to adhere a portion of the tamper-evident seal to a second packaging component in the first configuration, and further configured to split, exposing a non-adhesive surface. The splittable adhesive further includes an indication surface that is only visible once the splittable adhesive is separated such that the opening of the tamper-evident seal is apparent.

Some embodiments are directed to packaging, including a tray configured to contain a product in a closed configuration, a sleeve configured to receive the tray, and a tamper-evident seal including a paper substrate fixed to the tray and folded over to an exterior surface of the sleeve in a first configuration, and a splittable adhesive configured to adhere a portion of the paper substrate to the exterior surface of the sleeve in the closed configuration, and further configured to split in response to a force away from the exterior surface of the sleeve, thereby exposing a non-adhesive surface. In response to a force applied to the tamper-evident seal away from the sleeve, the paper substrate is decoupled from the exterior surface of the sleeve via the splitting of the splittable adhesive while remaining fixed to the tray, such that the tamper-evident seal serves as a pull-tab to remove the tray from the sleeve to access a product contained within the packaging.

In some embodiments, the splittable adhesive further comprises an indication surface including a portion of splittable adhesive left on the tray once separated, such that the opening of the tamper-evident seal is apparent. The tamper-evident seal does not tear during removal from the packaging.

Some embodiments are directed to packaging, including a closure element including a tamper-evident seal. The tamper-evident seal includes a first panel, a second panel, and an coupling element that couples the first and second panel in a closed configuration. When the first and second panels are uncoupled, an indicator of tampering is provided. In some embodiments, the indicator of tampering comprises a perforated tear where a portion of material is left behind on the first or second panel.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
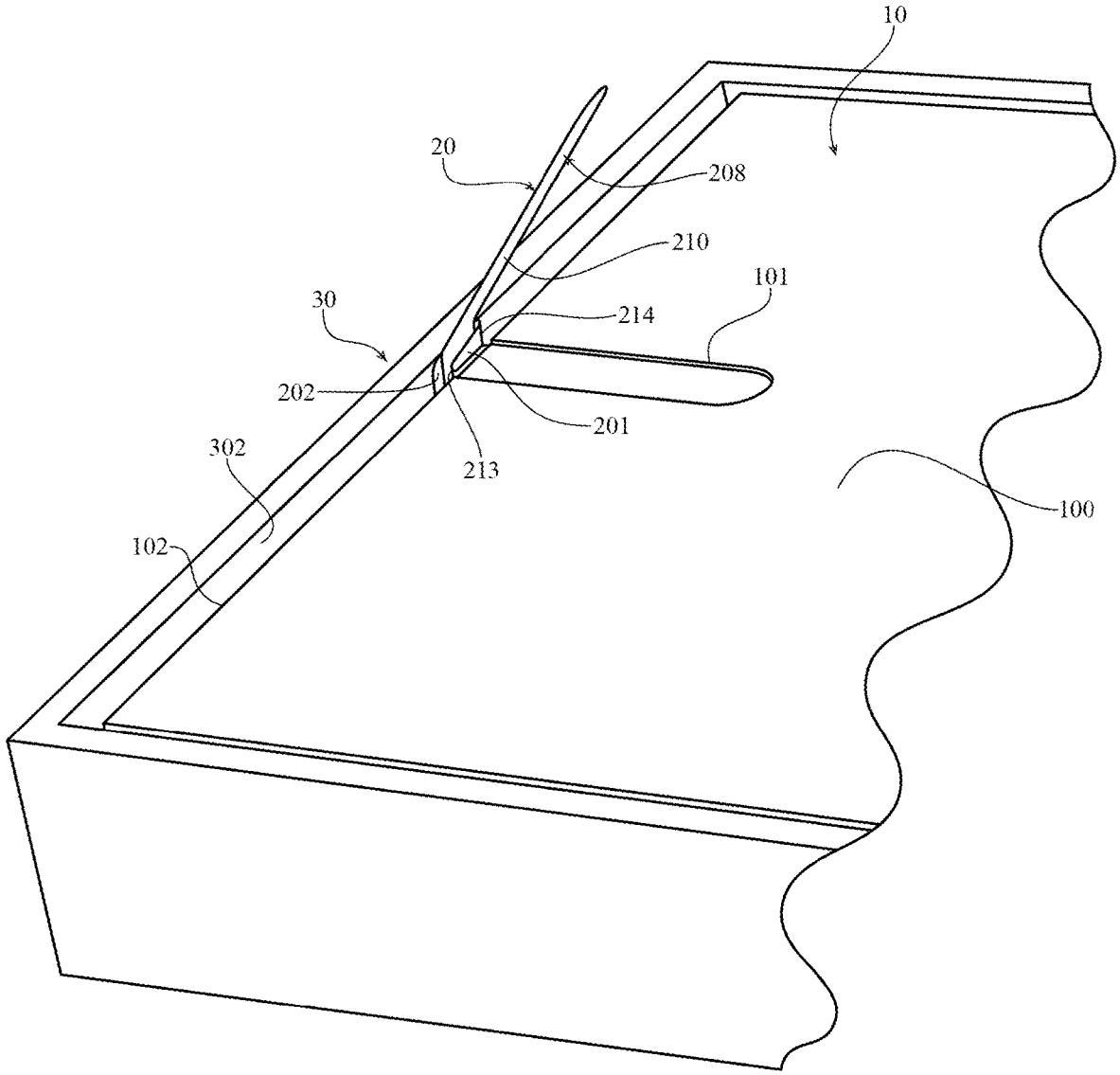
FIG. 1 shows a bottom perspective view of packaging with base box, lid, and tamper-evident seal in an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The packaging described herein provides a packaging solution utilizing environmentally friendly materials and allows for a tamper-evident seal to provide added assurance to a customer or a retailer that the packaging has not been opened or tampered with (e.g., there has been an "unauthorized" opening of a package prior to the intended opening). A base box and lid are disclosed that together in a first configuration, include a removable tamper-evident seal which does not require plastic film around an entire package, thereby easing recyclability. Elements are described that achieve a structurally sound package, while allowing an end user to easily recycle the package, while providing assurance against tampering.

Some embodiments include packaging including a base box comprising cardboard, e.g., paperboard or cardboard corrugate (other environmentally friendly recyclable materials are also envisioned). In some embodiments, each panel of the base box or lid or both may be formed from a continuous sheet (e.g., a cardboard blank). The tamper-evident seals described herein also may be formed from paper materials, or other environmentally friendly or recyclable materials. The respective elements may be formed of the same material or different materials (e.g., different cellulose-based material) that are recyclable in the same fiber-recycling stream. Advantageously, this improves upon prior systems having, for example, whole-package enveloping plastic film tamper-evident seals.

Companies may be sensitive to the cost of packaging and may wish to promote packaging that is eco-friendly. Certain packaging materials are higher cost due to their processing, and while engineers may be able to design single-component packaging, the cost may be prohibitive for certain materials. Optimization of packaging in material usage may help keep costs low, and if done well may not interfere with, and may promote, a positive user experience. Packaging made out of recyclable and/or biodegradable materials, such as paper or other cellulose-based products can reduce environmental impact, especially when it is intuitive for a customer to properly recycle. Packaging that is interesting in character and well-executed may boost a product's or a brand's reputation, thereby attracting new customers and retaining previous customers. Packaging described in this document achieves these and other beneficial characteristics by balancing structural robustness, eco-friendly materials, and aesthetic elements. A product contained by the packaging may be, for example, an electronic device such as, for example, a desktop, monitor, laptop, tablet computer, or smartphone, or it may be a non-electronic device.

In some embodiments, the packaging may be retail packaging (i.e., finished packaging for containing and conveying a product to a user such as may be used in a retail setting, not shipping packaging for containing a packaged product during shipment) that one may expect to find on the shelf in a retail store, and which one may open after purchase to directly access their product. In some embodiments, features of the tamper-evident seals disclosed herein are relatively hidden, and contribute to a clean and well executed finished packaging. As an example, tamper-evident seals may not be visible from the top or sides of the closed packaging, and instead be visible from the bottom of the packaging only.

These and other embodiments are discussed below with reference to the accompanying figures. However, those skilled in the art will readily appreciate that the detailed description given herein with respect to these figures is for explanatory purposes only and should not be construed as limiting.

FIG. 1 shows a bottom perspective view of packaging with base box 10, lid 30, and tamper-evident seal 20 in an embodiment. As shown in FIG. 1, base box 10 includes a first side panel 102 and a base panel 100. As shown, base panel 100 shows the bottom surface of base box 10. In some embodiments, lid 30 may be lowered onto base box 10 such that a second side panel 302 of lid 30 may be parallel to the first side panel 102. Tamper-evident seal 20 is formed from a paper substrate 210 and disposed between the first and second side panels 102/302 when the base box 10 and lid 30 are in a closed configuration. Although paper is used to describe the substrate in various embodiments described herein, and while paper can provide benefits such as improved recyclability, in some embodiments other non-paper materials may be used for the substrate.

While a gap is shown exaggerated in the figures for ease of explanation, in use, the interface between base box 10 and lid 30 may be closed and flush together (i.e., first side panel 102 may be flush with second side panel 302 with tamper-evident seal 20 fitted in between them). In some embodiments, an indentation or debossing feature may be included on either the lid or base box to effectively hide the tamper-evident seal, outside of the portion on the outside of the packaging. The depth and shape of the indentation matches the thickness and shape of the portion of the tamper-evident seal 20 within the base box 10 and lid 30 in order to not interfere with the fit of the lid on the base. Tamper-evident seal 20 includes a first adhesive portion attached to the first side panel 102, a second adhesive portion attached to the second side panel 302, and a tab 208 extending to an exterior of the packaging and accessible to a user. In some embodiments, an indentation 101 or debossing feature may be included on the base panel 100, to receive tab 208, so that it does protrude from the base box 10. When tab 208 is pulled with sufficient force, the paper substrate 210 tears such that the first adhesive portion and the second adhesive portion remain fixed to the first and second side panels 102/302, respectively, while the remainder of the paper substrate 210 tears free. This process is illustrated schematically in a sequence of figures shown in FIGS. 2-4.

To install tamper-evident seal 20, the adhesive portion attaching tamper-evident seal 20 to base box 10 may be exposed and fixed to the first side panel 102, and the lid 30 lowered onto the base box 10. Before lid 30 is lowered onto base box 10, the adhesive portion attaching tamper-evident seal 20 to base box 10 may be unexposed (e.g., a tape backing may be present so that it does not unintentionally stick to an unwanted surface). After the lid 30 and base box 10 are closed, the backing may be removed (e.g., by having an extended tab of backing protruding from the closed packaging), and second side panel 302 may be pressed inward toward first side panel 102, thereby fixing tamper-evident seal 20 between the respective side panels.

Figure 2:
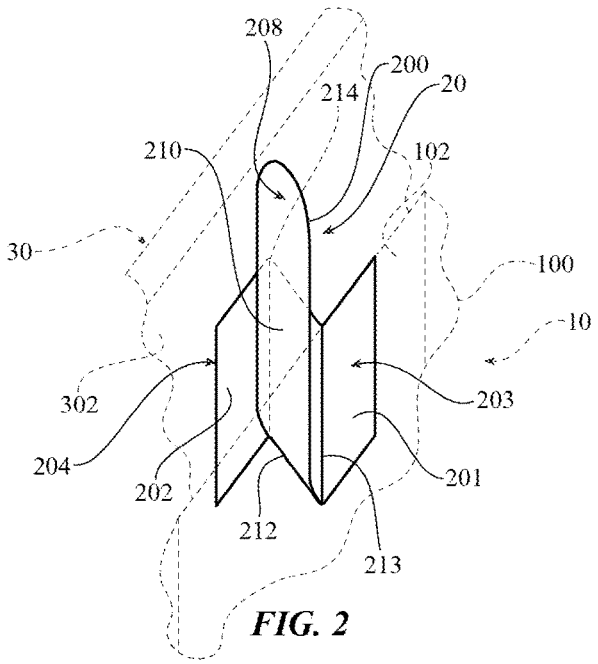
FIG. 2 shows a schematic view of a tamper-evident seal in an embodiment in a first configuration.
Figure 3:
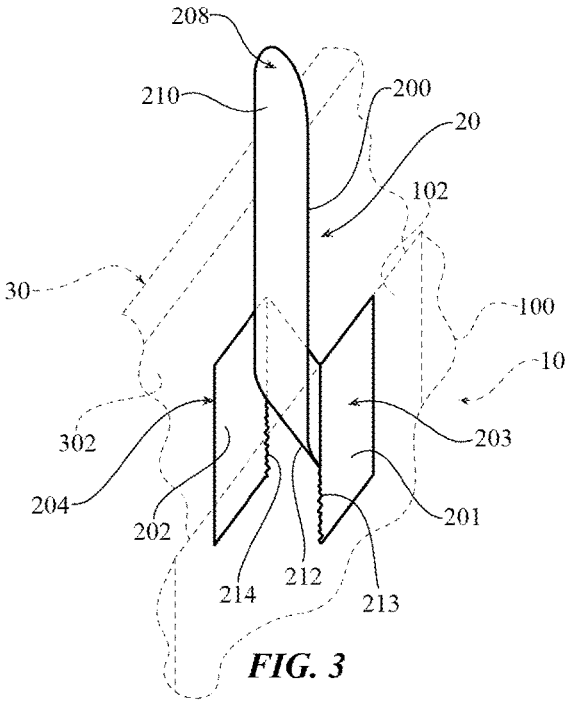
FIG. 3 shows a schematic view of the tamper-evident seal shown in FIG. 2 in a second configuration.

FIG. 2 shows a schematic view of a tamper-evident seal in an embodiment in a first configuration, where the tamper-evident seal 20 is disposed between base box 10 and lid 30. As shown in FIG. 2, tamper-evident seal 20 includes paper substrate 210. Tab 208 is configured to extend to an exterior of the packaging when the tamper-evident seal 20 is applied. As shown in FIG. 2, when tab 208 is pulled with sufficient force, the paper substrate 210 tears at tear paths 205 and 206, such that the first adhesive portion 203 and the second adhesive portion 204 remain fixed to the first and second side panels 102/302, respectively, while the remainder of the paper substrate 210 tears free. This may allow the packaging to be opened, since lid 30 will no longer be coupled to base box 10 by tamper-evident seal 20. FIG. 3 shows a schematic view of the tamper-evident seal shown in FIG. 2 in a second configuration, where the remaining paper substrate 210 may be removed from between base box 10 and lid 30. While the tamper-evident seal 20 is shown in an exaggerated zig-zag arrangement for ease of explanation, in use the panels of paper substrate 210 would be folded flat against each other to fit within the narrow gap between the side panels 102/302.

Figure 4:
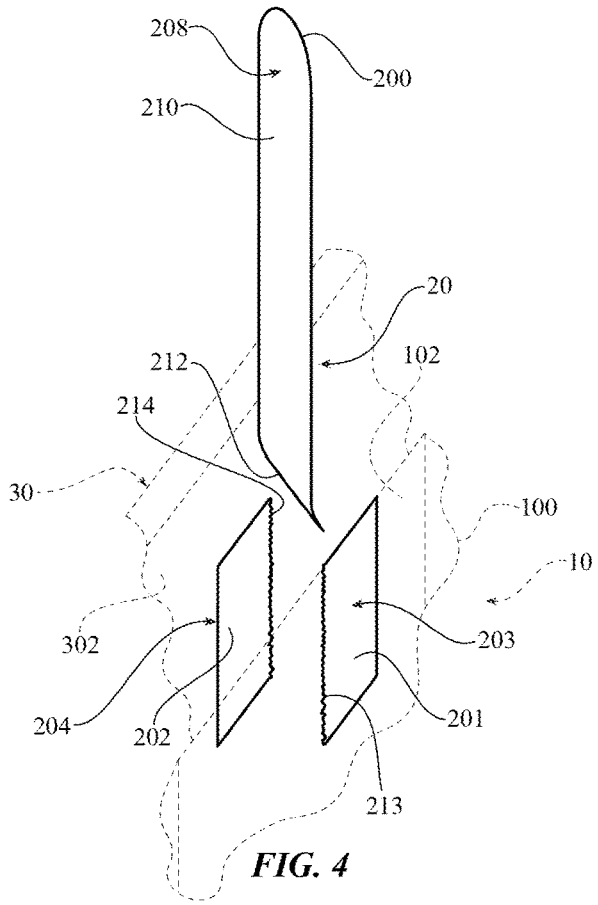
FIG. 4 shows a schematic view of the tamper-evident seal shown in FIG. 2 in a third configuration.

As shown in FIG. 2 for example, the paper substrate 210 is configured to tear to create tear paths 205 and 206, extending along the direction of the pull force. Tear paths may be formed at folds 213/214. As shown in FIGS. 2-4, the paper substrate 210 may include a first portion 200 extending in a first direction, as well as second portion 201 and third portion 202 extending in opposing directions. In this way, the first, second, and third portions together form a T-shape. In some embodiments, the first portion 200 is folded over onto itself at a first fold 212. The second and third portions are each respectively folded at second and third folds (213 and 214, respectively) around a portion of the overlap of the first portion 200 formed by the first fold 212. This forms a zig-zag configuration, where the elongated first portion 200 is effectively sandwiched between the second and third portions of the paper substrate 210.

As shown in FIGS. 3 and 4, in response to a force applied in a direction away from the packaging, the paper substrate 210 is configured to tear such that first portion 200 tears free along a first line 205 and second line 206 parallel to the folds 213/214 of the second and third portions. FIG. 4 shows a schematic view of the tamper-evident seal 20 shown in FIG. 2 in a third configuration, where first portion 200 is free from the packaging. In some embodiments, the base box 10 (or lid 30) further includes an indentation 101 to receive a portion of the tamper-evident seal 20 (e.g., tab 208) on the outside of the base box (as shown in FIG. 1). The first portion of the paper substrate 210 further may include a releasable adhesive to engage the indentation (or other packaging surface) when the packaging is in a closed configuration in some embodiments. In some embodiments, this releasable adhesive is disposed on tab 208, outside of the folded over portion such that it may be adhered to an outside packaging surface). In this way, the tab 208 may be kept out of the way and more or less flush with the packaging before an end user is ready to tear tamper-evident seal 20 away from the packaging and remove lid 30 from base box 10.

Figure 5:
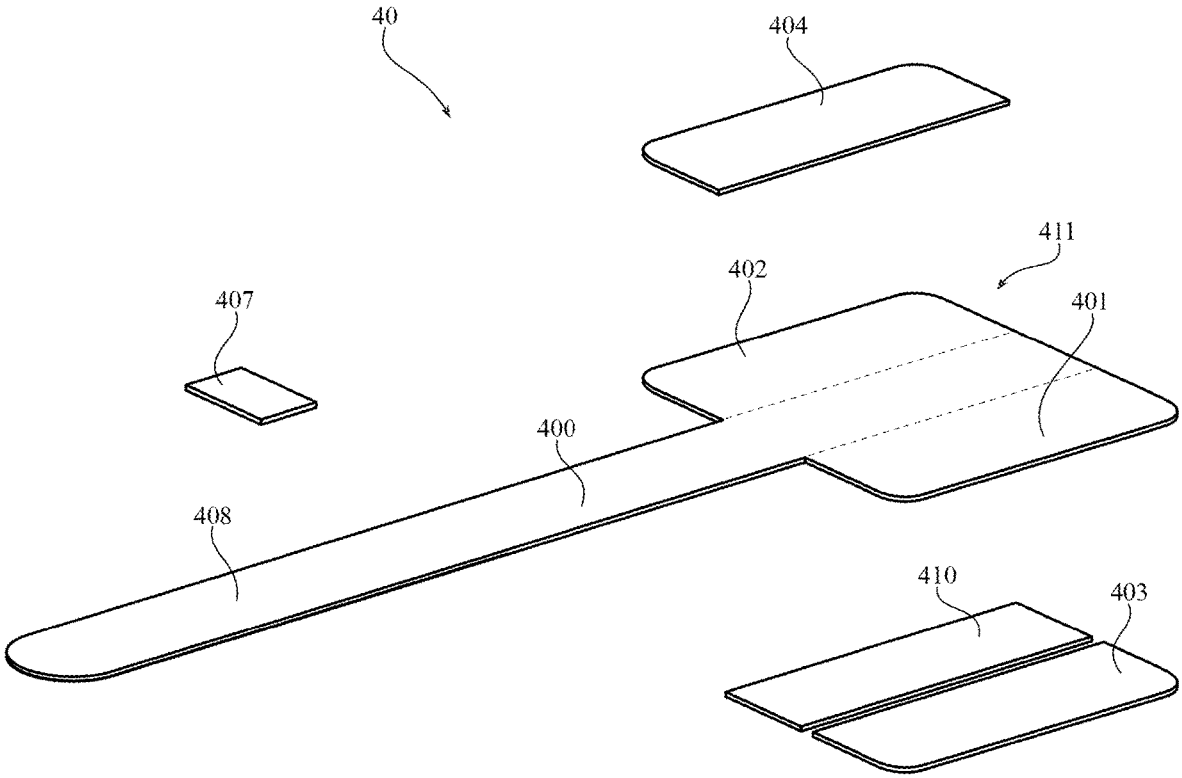
FIG. 5 shows an exploded view of a tamper-evident seal in an embodiment.

Turning to FIG. 5, an exploded view of a tamper-evident seal 40 in an embodiment is shown. Elements and features of tamper-evident seal 40 may be used with tamper-evident seal 20, and vice versa, and with any other tamper-evident seal disclosed herein. As shown, tamper-evident seal 40 includes paper substrate 411 including a first portion 400, and second and third portions 401 and 402, respectively. In this way, the first, second, and third portions together form a T-shape in an unfolded state. Tab 408 extends as part of first portion 400. In FIG. 5, broken lines show the boundaries of the respective portions, and denote where the folds will be, as shown in FIG. 5.

The tamper-evident seal 40 may include first adhesive portion 403 and second adhesive portion 404. In some embodiments, one of the first or second adhesive portions (or both) includes or is formed from fiber tape. The first adhesive portion 403 is attached to a surface of the second portion 401 of the paper substrate 411, and the second adhesive portion 404 is attached to a surface of the third portion 402 on the opposite side of the paper substrate. In this way, looking to FIG. 6, when the second and third portions of the paper substrate are folded in the zig-zag pattern, the respective adhesive portions are facing outward, such that they may be coupled to a first side panel that is facing a second side panel of a base box/lid configuration. In some embodiments, one of the first or second adhesive portions (or both) includes fiber tape. In some embodiments, the paper substrate does not include perforations.

Figure 6:
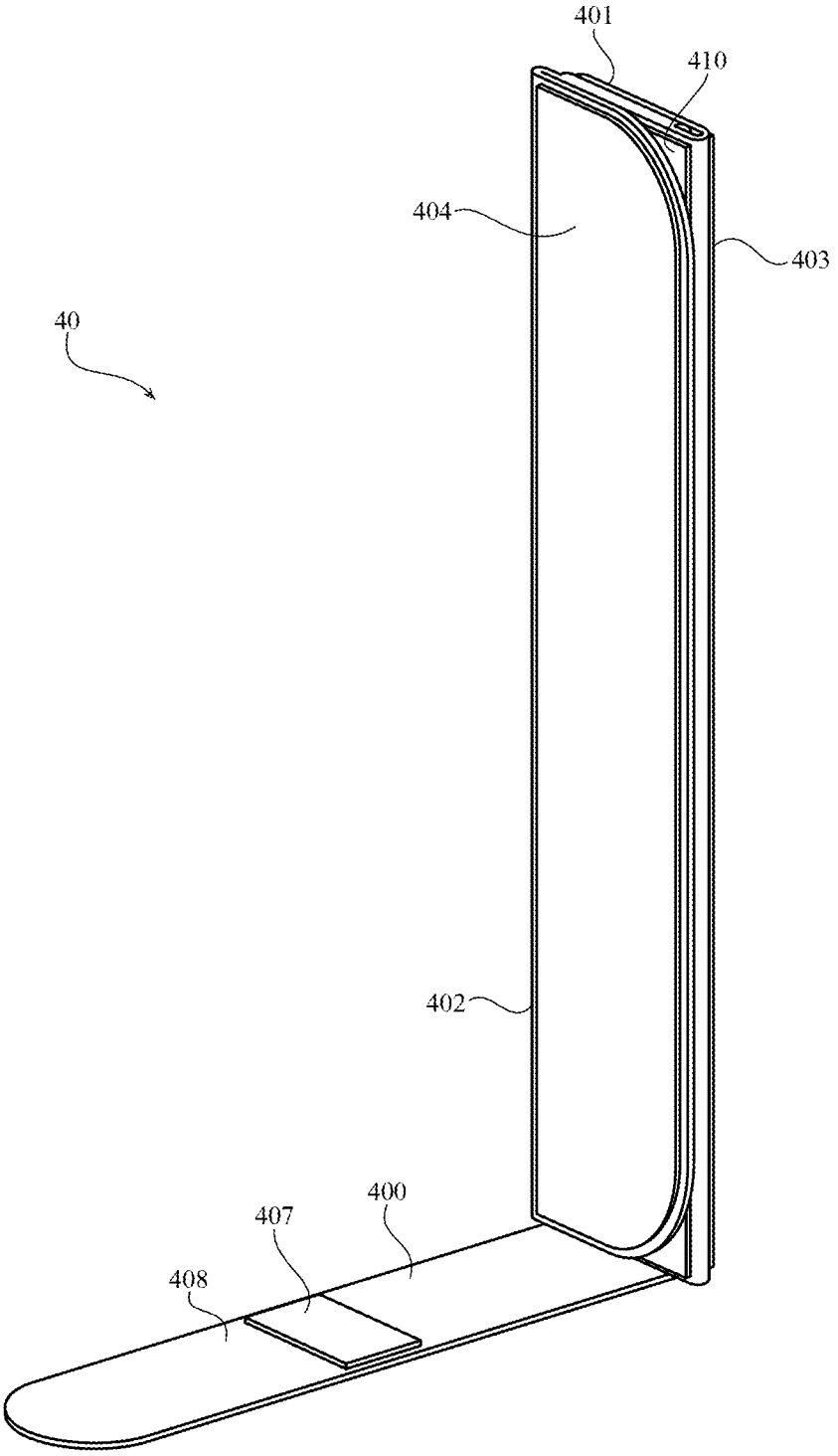
FIG. 6 shows an assembled view of the tamper-evident seal shown in FIG. 5.

As shown in FIGS. 5 and 6, tamper-evident seal 40 further includes a stiffening element 410 fixed to the first portion 400 of the paper substrate. Stiffening element 410 increases stiffness of the first portion 400 relative to one of the second or third portions (or both). In this way, once in an assembled configuration and applied to the base box 10 and lid 30, stiffening element 410 provides additional strength in the first portion 400 such that it improves tearability when tamper-evident seal 40 is applied in use. In FIG. 5, widths of the individual portions of the paper substrate are equal, including the width of the second and third portions. Turning to FIG. 6, the assembled and folded tamper-evident seal 40 is shown for context. Tamper-evident seal 40 can be applied between lid 30 and base box 10 in the same manner as shown in FIGS. 1 and 2-4 to tamper-evidently seal the packaging.

Third adhesive portion 407 may be fixed to tab 408, such that it may be releasably coupled to a box or lid to keep it out of the way until an end user desires to remove tamper-evident seal 40.

Figure 7:
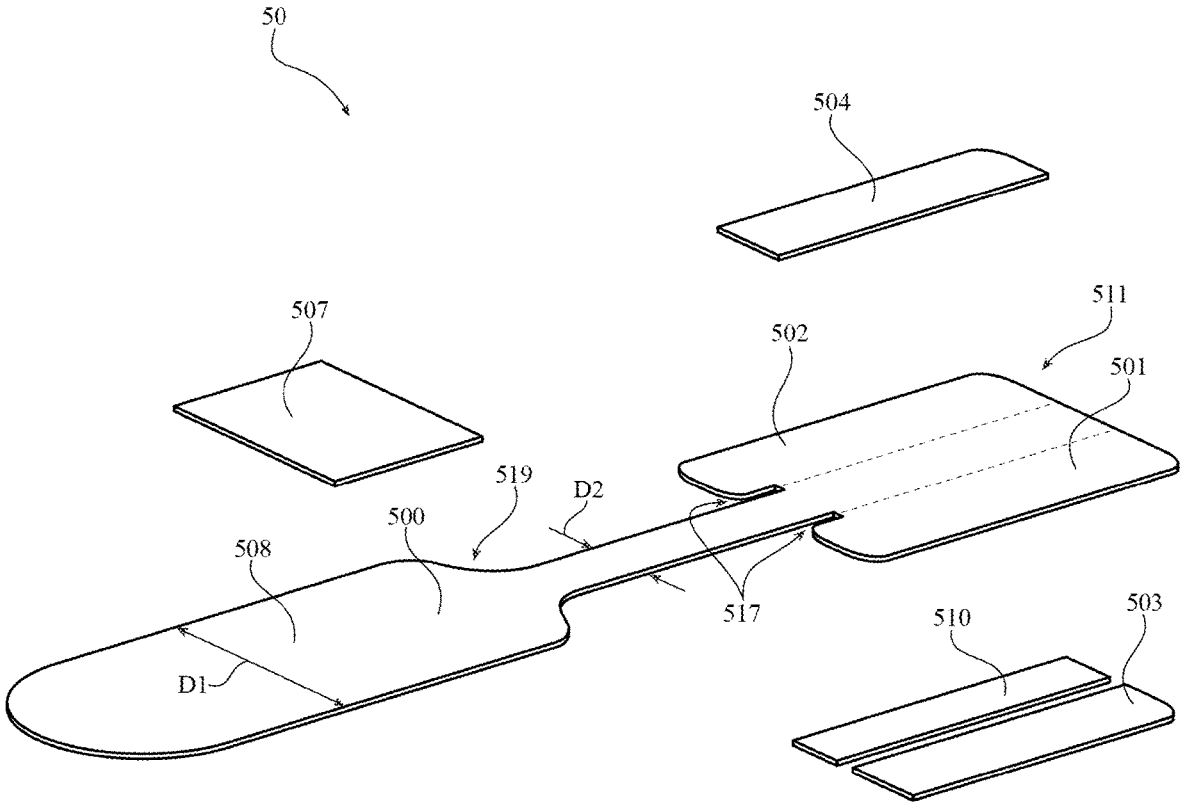
FIG. 7 shows an exploded view of a tamper-evident seal in an embodiment.
Figure 8:
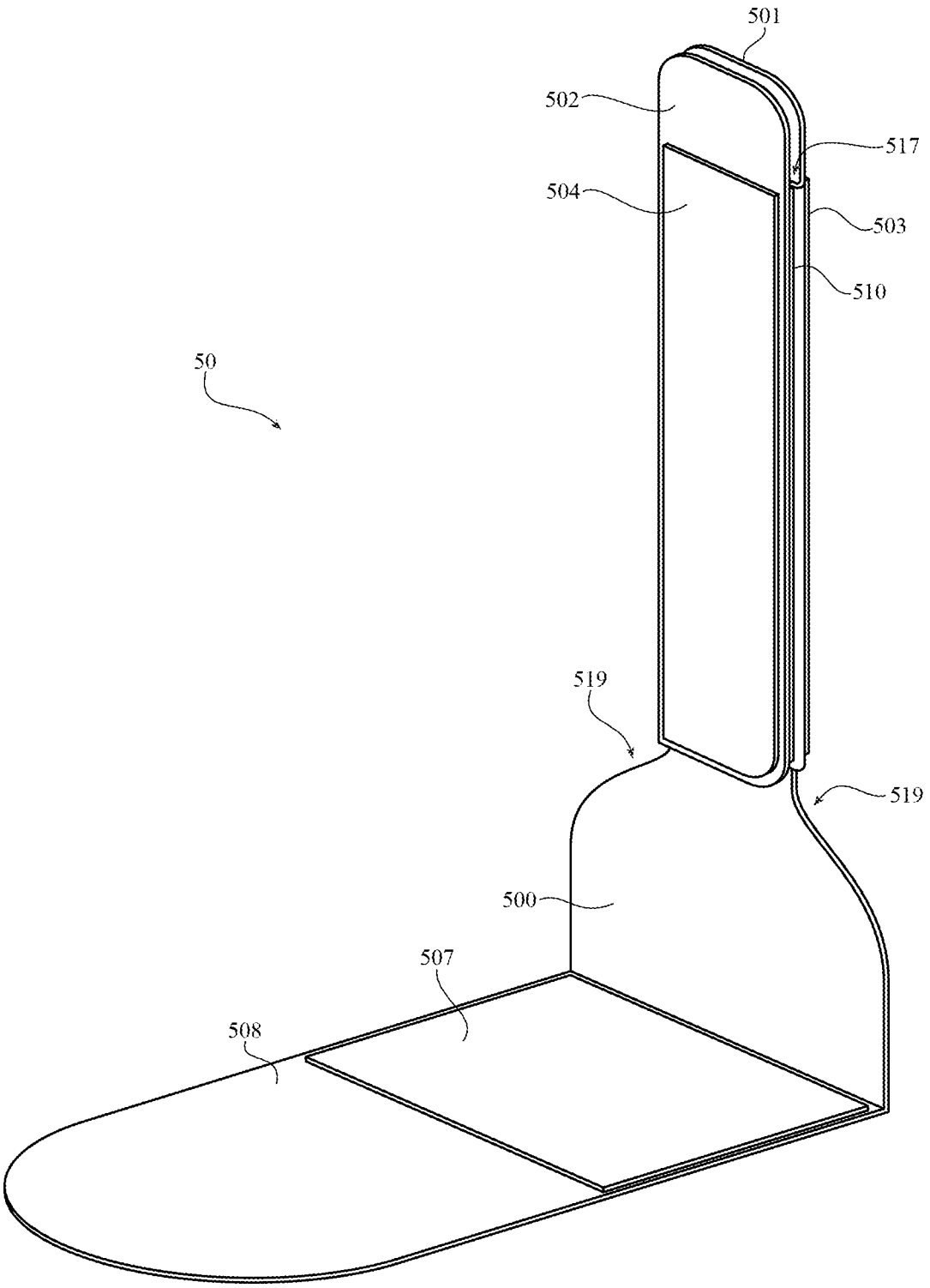
FIG. 8 shows an assembled view of the tamper-evident seal shown in FIG. 7.

Turning to FIG. 7, an exploded view of a tamper-evident seal 50 is shown. FIG. 8 shows an assembled view of the tamper-evident seal shown in FIG. 7. Elements and features of tamper-evident seal 50 may be used with tamper-evident seal 20 and/or tamper-evident seal 40, and vice versa. Indeed, elements and features of each tamper-evident seal disclosed herein may be used with each other tamper-evident seal disclosed herein, and vice versa. As shown, tamper-evident seal 50 includes paper substrate 511 including a first portion 500, and second and third portions 501 and 502, respectively. In this way, the first, second, and third portions together form a T-shape having a widened base in an unfolded state. Tab 508 extends as part of first portion 500.

The tamper-evident seal 50 may include first adhesive portion 503, and second adhesive portion 504. In some embodiments, one of the first or second adhesive portions (or both) includes or is formed from fiber tape. The first adhesive portion 503 is attached to a surface of the second portion 501 of the paper substrate, and the second adhesive portion 504 is attached to a surface of the third portion 502 on the opposite side of the paper substrate. In this way, looking to FIG. 8, when the second and third portions of the paper substrate are folded in the zig-zag pattern, the respective adhesive portions are facing outward, such that they may be coupled to a first side panel that is facing a second side panel of a base box/lid configuration. In some embodiments, one of the first or second adhesive portions (or both) includes fiber tape, in addition to other components. In some embodiments, the paper substrate does not include perforations.

As shown in FIGS. 7 and 8, tamper-evident seal 50 further includes a stiffening element 510 fixed to the first portion 500 of the paper substrate. Stiffening element 510 increases stiffness of the first portion 500 relative to one of the second or third portions (or both). In this way, once in an assembled configuration and applied to the base box 10 and lid 30, stiffening element 510 provides additional strength in the first portion 500 such that it improves tearability when tamper-evident seal 50 is applied in use. In this way, the stiffening element 510 promotes tearing along the folds of tamper-evident seal 50, and not across the first portion 500. This helps ensure that the first portion 500 tears entirely free rather than the tab 508 tearing off prematurely before entirely separating the second portion and third portion. In FIG. 7, widths of the individual portions of the paper substrate may vary. As shown, the paper substrate may include tab 508 having an increased width D1 relative to a separate portion of the first portion 500 of the paper substrate. However as with other embodiments, the width of the second and third portions (501/502) may be equal. The width along first portion 500 may transition, e.g. at transition region 519.

In some embodiments, the paper substrate includes stress concentration features, such as cuts or notches 517. Stress concentration features 517 may be formed at an intersection point of the first and second and first and third portions, respectively. In this way as the tamper-evident seal 50 is folded as shown in the full configuration of FIG. 8, these features are approximate where a tear line would form if tab 508 was pulled with sufficient force such that the tamper-evident seal 50 would be removed. This helps to make it easier to begin tearing tamper-evident seal 50, reducing the force needed to initiate the tears.

Turning to FIG. 8, the assembled and folded tamper-evident seal 50 is shown for context. Third adhesive portion 507 may be fixed to tab 508, such that it may be releasably coupled to a box or lid to keep it out of the way until an end user desires to remove tamper-evident seal 50. Tamper-evident seal 50 can be applied between lid 30 and base box 10 in the same manner as shown in FIGS. 1 and 2-4 to tamper-evidently seal the packaging.

Figure 9:
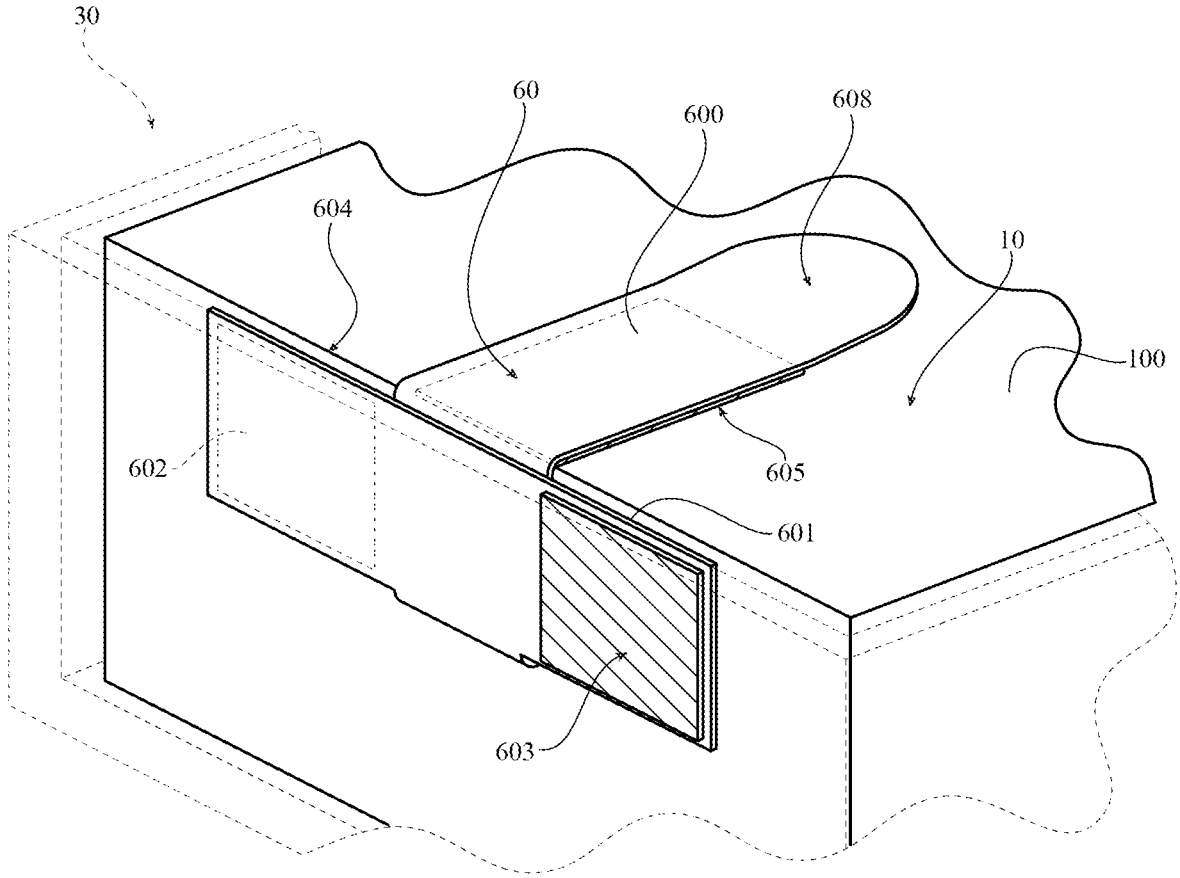
FIG. 9 shows a perspective view of packaging with base box, lid, and tamper-evident seal in an embodiment.
Figure 10:
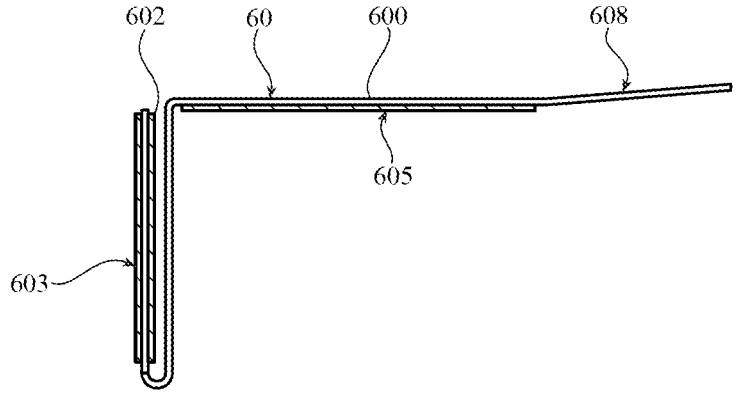
FIG. 10 shows a side view of the tamper-evident seal shown in FIG. 9.
Figure 11:
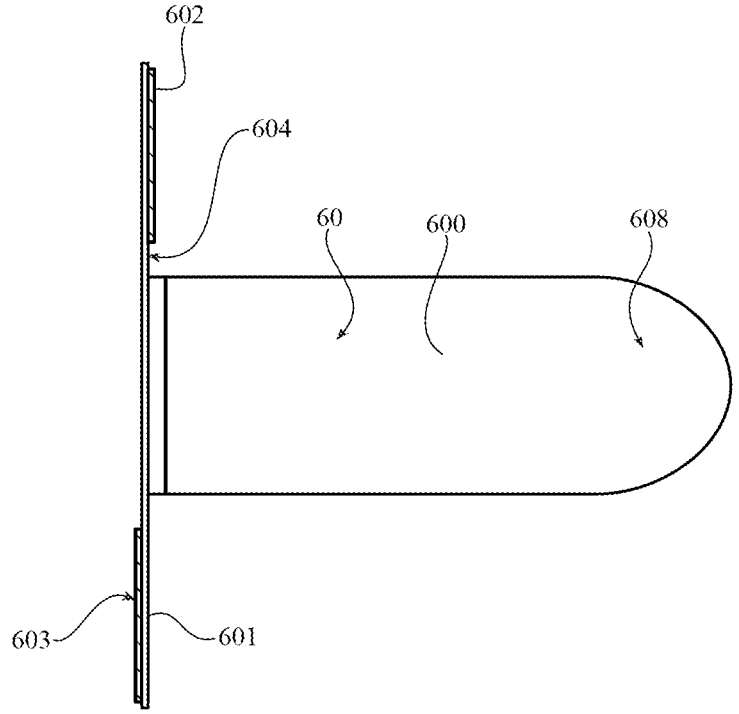
FIG. 11 shows a top view of the tamper-evident seal shown in FIG. 9.

FIG. 9 shows a perspective view of packaging with base box 10, lid 30, and tamper-evident seal 60 in an embodiment. FIG. 10 shows a side view of tamper-evident seal 60 shown in FIG. 9, and FIG. 11 shows a top view of tamper-evident seal 60 shown in FIG. 9. Elements and features of tamper-evident seal 60 may be used with tamper-evident seal 20, 40, and/or 50, and vice versa.

As shown in FIG. 9, tamper-evident seal 60 includes a paper substrate 600, a first adhesive 605 coupling paper substrate 600 to the base panel 100, a second adhesive 603 coupling paper substrate 600 to the second side panel 302 of lid 30, and, in some embodiments, a third adhesive 604 coupling paper substrate 600 to the first side panel 102 of the base box 10. In response to a force applied in a direction away from the packaging, one or more of the adhesives are configured to peel away from their respective panels—such that paper substrate does not tear. In contrast to some of the illustrated embodiments, tamper-evident seal 60 may not include a fold over onto itself along a first portion between extension portions 601 and 602, as they are extended in a T-shape and do not fold onto the extended portion. But tamper-evident seal 60 may fold over onto itself along a first portion such that an additional length of tamper-evident seal 60 is held within the side panels of lid 30 and base box 10. Similarly, in contrast to some of the illustrated embodiments, tamper-evident seal 60 may not include the zig-zag folds of the extension portions around a central portion of the paper substrate 600.

As an alternative, in some embodiments, the paper substrate 600 may tear, e.g., along lines that would form at the intersection of the extension portions 601 and 602. In this way, tamper-evident seal may have a similar mechanism to the other tamper-evident seals disclosed herein, where the adhesive portions hold the paper substrate to the respective packaging surfaces such that a tear is required to uncouple the base box 10 and lid 30.

Figure 12:
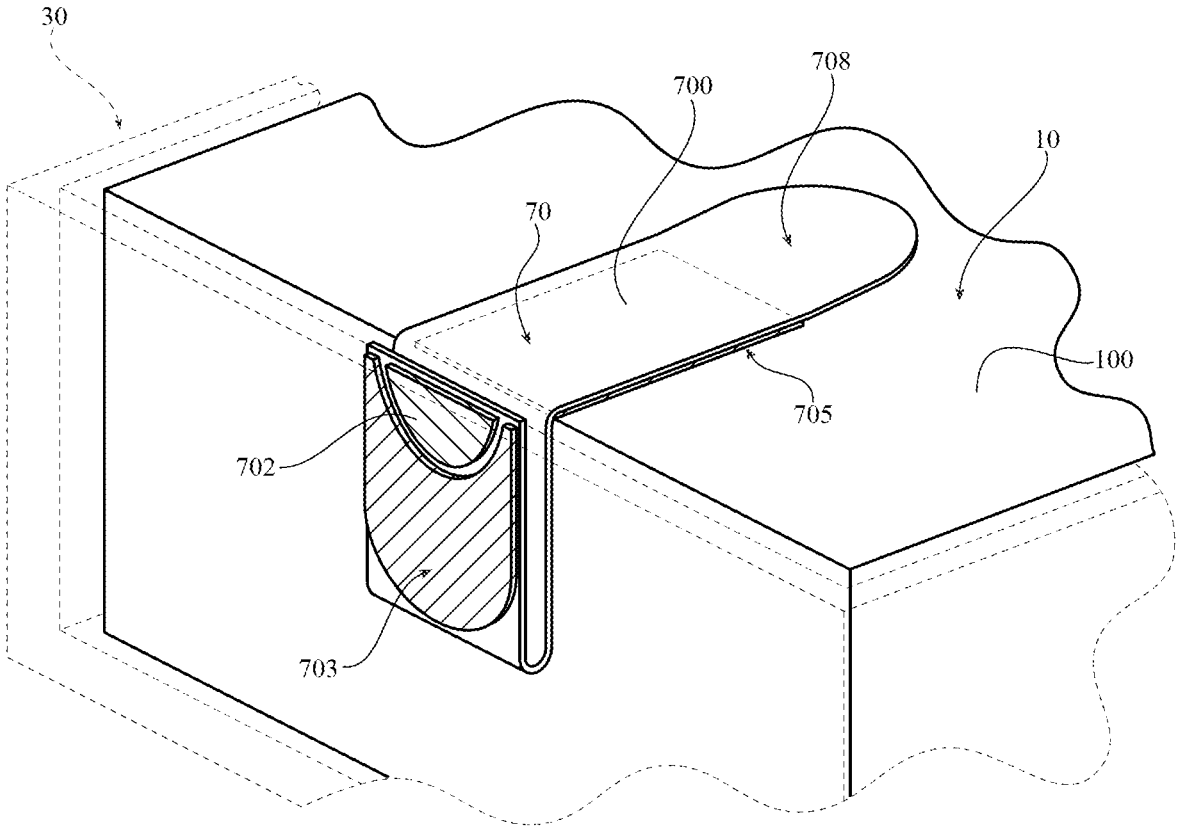
FIG. 12 shows a perspective view of packaging with base box, lid, and tamper-evident seal in an embodiment.
Figure 13:
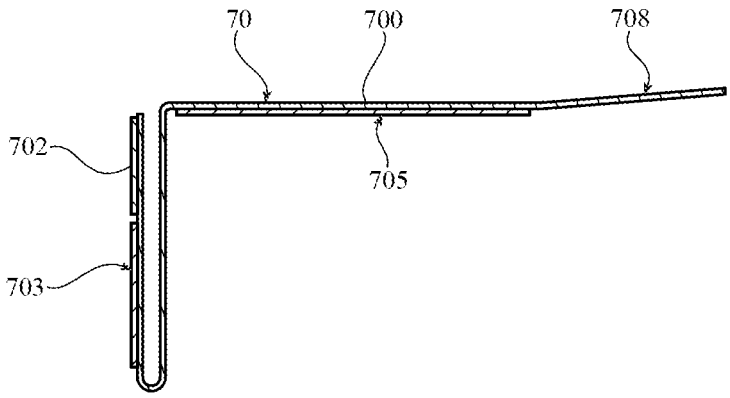
FIG. 13 shows a side view of the tamper-evident seal shown in FIG. 12.

FIG. 12 shows a perspective view of packaging with base box 30, lid 10, and tamper-evident seal 70 in an embodiment. FIG. 13 shows a cross-section of a side view of tamper-evident seal 70 shown in FIG. 12. Elements and features of tamper-evident seal 70 may be used with tamper-evident seal 20, 40, 50, and/or 60, and vice versa.

Tamper-evident seal 70 may include paper substrate 700, extending in a single direction (e.g., without portions extending along a different direction to form a "T" shape). Paper substrate 700 may be configured such that it does not tear during removal from the packaging. As shown in FIG. 12, a first adhesive 705 couples the paper substrate 700 to the base panel 100. A second adhesive 703 couples paper substrate 700 to the second side panel of lid 30. In some embodiments, a third adhesive 702 couples paper substrate 700 to the second side panel 302 at a different position from second adhesive 703. Each of the adhesives may be part of the tamper-evident seal itself (rather than, for example, being attached to a separate component or introduced in a separate operation).

In response to a force applied in a direction away from the packaging (e.g., at tab 708), one or more of the adhesives are configured to peel away from their respective panels—such that paper substrate 700 does not tear. As a mechanism of tamper-evidence, the adhesives are configured such that they may not be able to be used or reapplied once tamper-evident seal 70 is removed, e.g., by exposing a non-adhesive surface, or simply leaving the adhesive surface attached to the packaging during removal of the tamper-evident seal. Third adhesive 702 may have a stronger shear strength than the second adhesive 703 (or vice versa) in order for the tamper-evident seal 70 to be removed from the packaging. In some embodiments, the paper substrate 700 is not attached to the first side panel 102 of the base box 10. The paper substrate 700 extends along the base panel 100, folding inward and along the first side panel 102, and doubles back on itself such that the second adhesive 703 may be coupled to the second side panel in some embodiments, such as shown in FIG. 13.

In some embodiments, third adhesive 702 may be a permanent adhesive, such that as tab 108 is pulled and the paper substrate 700 rolls through the opening between the base box 10 and lid 30, the paper substrate 700 begins to tear between third adhesive 702 and second adhesive 703. And second adhesive 703 is not a permanent adhesive, and may be removable such that it may peel away from the surface it is initially attached to. In this way, a portion of paper substrate 700 is left on the inside wall of lid 30, and thereby indicates the package has been opened, even after tamper-evident seal 70 is removed from the packaging. In some embodiments, the area, shape, or other dimensional characteristics of the paper substrate 700 or portions between adhesives may be tailored to provide an easy tearing solution, while maintaining a sufficient seal and providing tamper-evidence once the seal is removed. In this way, for adhesives that are intended to peel off (e.g., removable adhesives), they peel away at an applied force on the tamper-evident seal portion (e.g., pull tab) that is less than that which would tear the substrate (e.g., tear strength of the substrate). In contrast, for adhesives that are not intended to peel off (e.g., permanent adhesives) the force required to remove them is greater than the force at which the substrate will tear.

Figure 14:
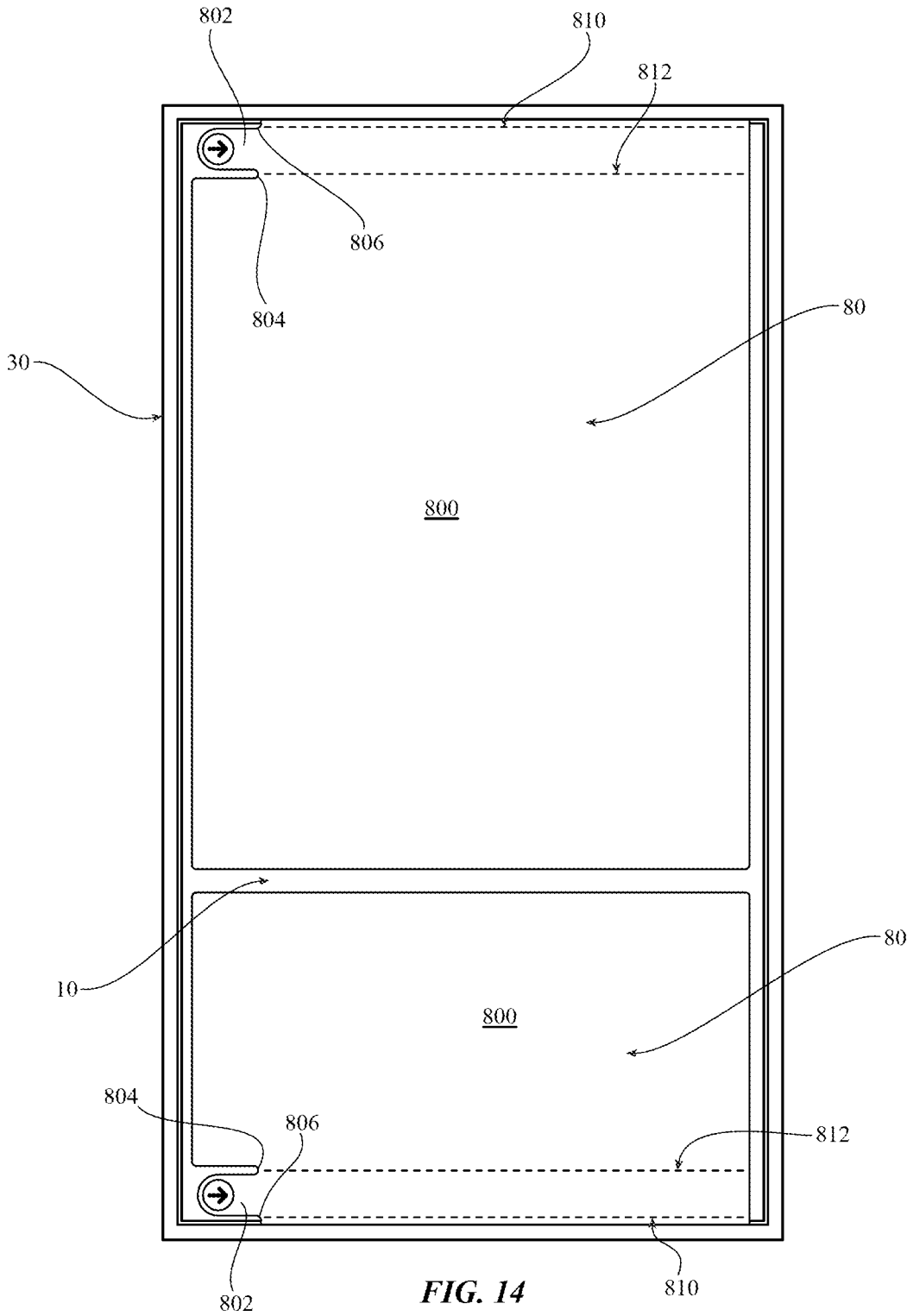
FIG. 14 shows a bottom view of packaging with tamper-evident seal in an embodiment.

Turning to FIG. 14, a bottom view of packaging is shown, including lid 30 and base box 10. As shown in the figure, the packaging is in a closed configuration, and includes tamper-evident seals 80. In some embodiments, tamper-evident seals 80 may include label surface 800, e.g., a label surface that may provide information about a product contained within the packaging. Label surface 800 may be coupled to the base box 10. Tamper-evident seal 80 may include one or more tab 802 that a user may use to pull along tear paths 810 and 812, respectively. The portion of the tamper-evident seal that tears away from the tamper evident seal may not be adhered at all (e.g., has no adhesive on it) such that it is more easily torn away from the packaging. In some embodiments, a relatively low-tack adhesive may be disposed at the terminal tearing end of the portion, e.g., proximate tab 802 or underneath an indicator (shown in FIG. 14 as an arrow inside a circle). In some embodiments tamper-evident seal 80 may include a notch 804 proximate tab 802 that may aid in a user beginning a tear in tamper-evident seal 80. In some embodiments tear paths 810 and 812 may include perforations, score lines, thin layers, or other features designed to allow easy and/or guided tearing of tamper-evident seal 80.

Figure 15:
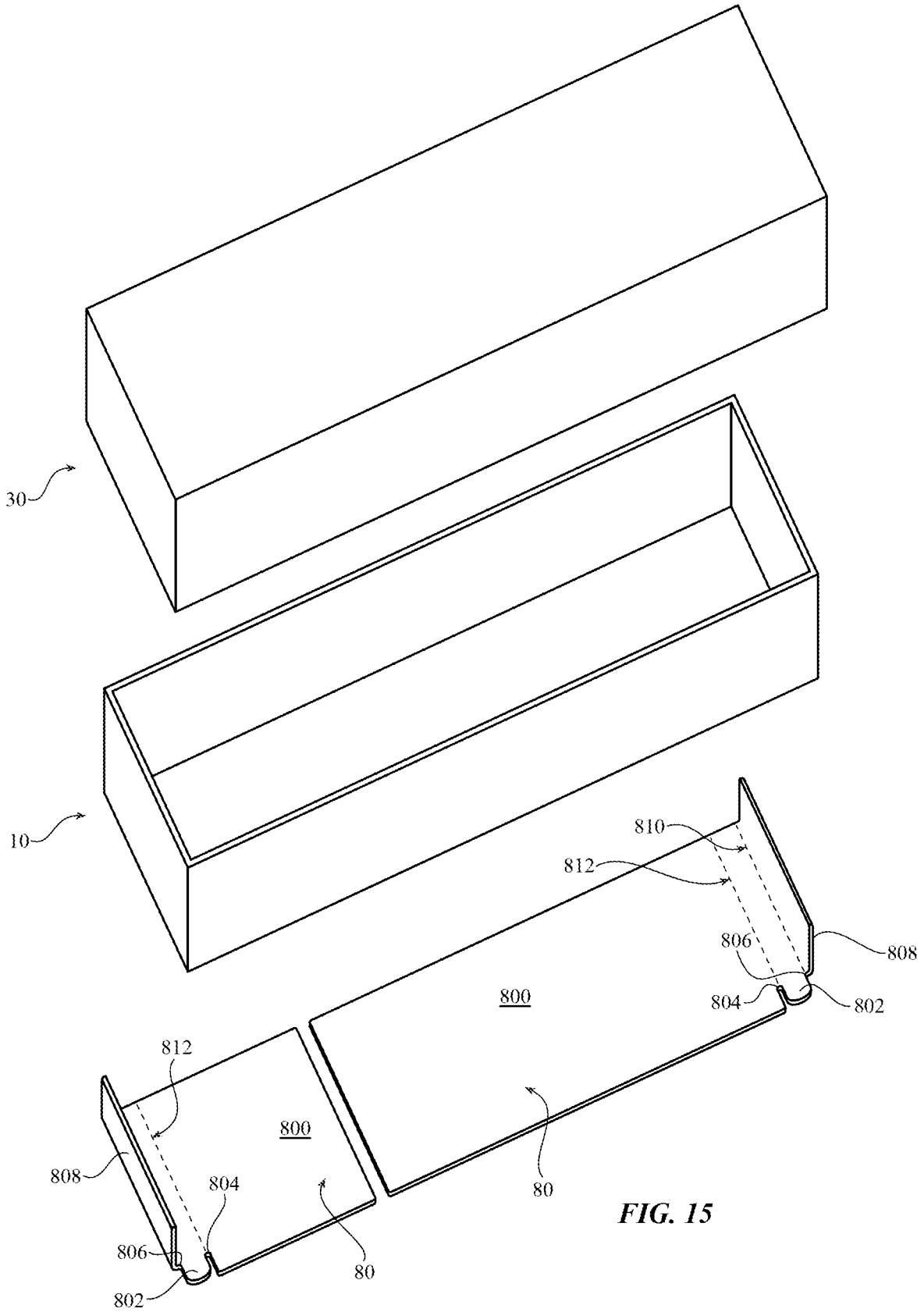
FIG. 15 shows an exploded perspective view of the packaging and tamper-evident seal shown in FIG. 14.

Turning to FIG. 15, an exploded perspective view of the packaging shown in FIG. 14 is shown. Similar to other embodiments, a panel 808 of tamper-evident seal 80 may be disposed between an outer surface of base box 10 and an inner surface of lid 30. Panel 808 may be fixed to an inner surface of lid 30 (e.g., by an adhesive portion), while being uncoupled from base box 10. In this way, tamper-evident seal 80 connects the base box 10 and lid 30 while a product is enclosed therein, but after a user detaches tab 802 by pulling along tear paths 810 and 812, the tamper-evident seal no longer connects base box 10 and lid 30, and the packaging may be opened. Due to the destructive nature of the tearing of tamper-evident seal 80, the tab 802 may not be reattached to panel 808 or label surface 800, thereby indicating the packaging seal has been broken. In some embodiments, the label surface 800 may be positioned on other sidewalls of either the base box 10 or lid 30.

In contrast to some embodiments described herein, tamper-evident seal 80 is configured such that the seal is only viewable on one side of the packaging, i.e., label portion 800. For example, label portion 800 may be viewable, but panel 808 may not be visible, because it will be disposed between side walls of base box 10 and lid 30 (see FIG. 14). This allows the viewable portion, (label portion 800) to serve a dual purpose as also being a label that remains on the package, even when the tamper-evident seal 80 is broken such that the packaging may be opened. Put simply, structurally, tamper-evident seal 80 has adhesives on opposite sides of the blank, in areas that do not overlap, and includes a band separating them that has no adhesive (i.e., the tear-away part facilitated by tab 802 along tear paths 810 and 812). For example, referencing FIG. 15, tamper-evident seal 80 in some embodiments includes adhesive on the upper side of label portion 800 and not on the lower side of label portion 800, and it has adhesive on the outer side of panel 808 and not on the inner side of panel 808. In some embodiments tamper evident seal 80 also has no adhesive on either side between tear paths 810 and 812.

Figure 16:
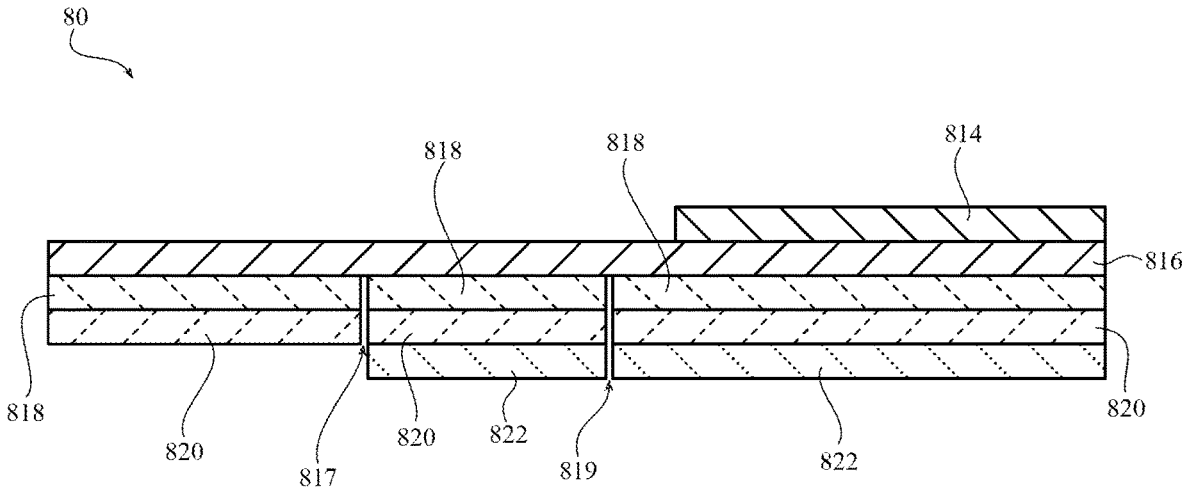
FIG. 16 shows a schematic side view of a portion of the tamper-evident seal shown in FIG. 14.
Figure 17:
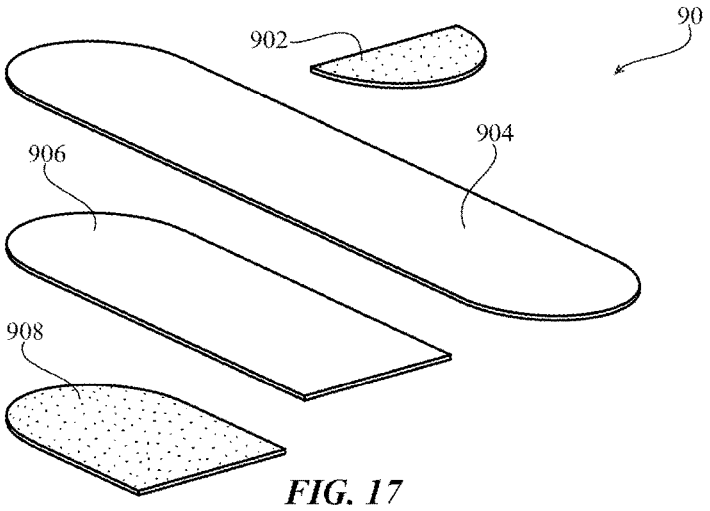
FIG. 17 shows an exploded perspective view of a tamper-evident seal in an embodiment.

This structure and function is shown further in FIG. 16. As shown, in some embodiments tamper-evident seal 80 may include one or more layers of materials. For example, the label 818, e.g., a paper label, may include several sections, whereby the section forming tab 802 is the central section shown in FIG. 16. As can be seen in figure, the separation at gaps 817 and 819 makes it such that only a lamination 816 must be torn through by a user in order to break the seal of tamper-evident seal 80, thereby easing the opening of tamper-evident seal 80 while retaining the tamper-evidencing features. As shown, additional layers of tamper-evident seal 80 may include adhesive layer 814 (configured to be fixed to lid 30), label adhesive layer 820, and one or more stiffener portions 822. In some embodiments, gaps 817 and 819 may correspond to tear paths 810 and 812. In this way, perforations are not used, which may provide a cleaner tear when a user desires to break the seal of tamper-evident seal 80. Moreover, having a stiffener between gaps 817 and 819 as part of tamper-evident seal 80 may improve tearability of lamination 816.

Turning to FIGS. 17-20, an exploded view of a tamper-evident seal 90 is shown. Tamper-evident seal 90 may include a first paper substrate 904, a second paper substrate 906 fixed to the first paper substrate 904, a removable adhesive 908, and a splittable adhesive 902.

Splittable adhesive 902, in some embodiments, may be coupled to a base box, such as base box 10. Splittable adhesive 902 may include opposing surfaces that may be fixed to opposing substrates. In some embodiments, splittable adhesive 902 may split, such that the surfaces fixed to the opposing substrates remain fixed to the respective substrates, while the splittable adhesive itself separates between its opposing surfaces, exposing non-adhesive inner surfaces. That is, once a splittable adhesive is in fact split, the newly-exposed inner surfaces, formerly interior to the splittable adhesive between its outer surfaces, do not re-adhere. In some embodiments of the splittable adhesive, once split the formerly interior surface does not stick to other components. In embodiments utilizing splittable adhesive, the splittable adhesive may provide the similar function to tearing of other embodiments, that is, the splitting of the adhesive layers decouples the tamper-evident seal such that the package may be opened.

Figure 18:
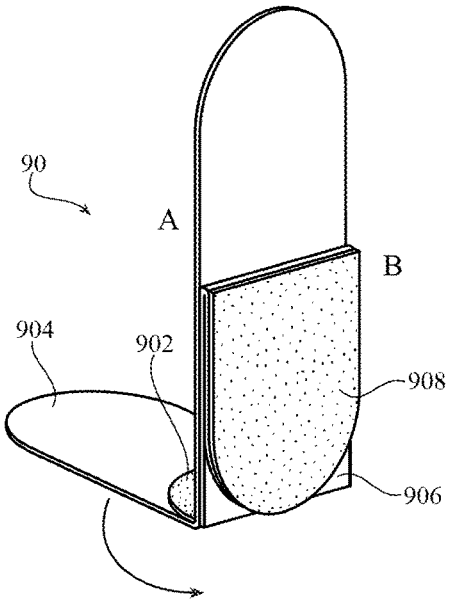
FIG. 18 shows a tamper-evident seal shown in FIG. 17 in a first assembled configuration.
Figure 19:
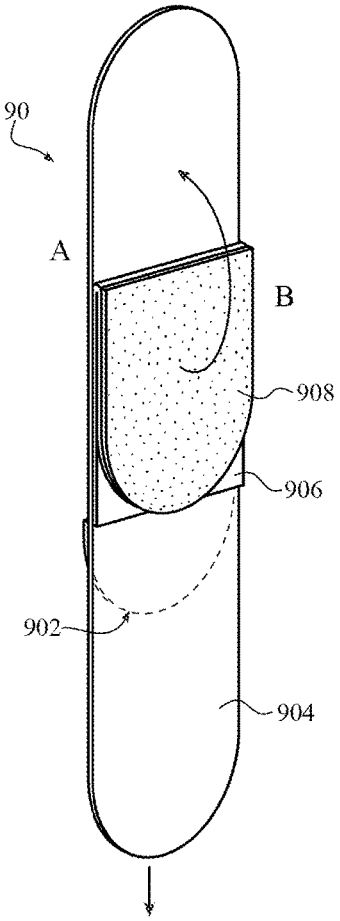
FIG. 19 shows a tamper-evident seal shown in FIG. 17 in a second assembled configuration.

As shown in FIG. 18, the area of paper substrate 904 that does not include splittable adhesive 902 may form a tab such that a user may pull a portion of splittable adhesive 902 away from the base box as shown by the arrow in FIG. 18. The portion of paper substrate 904 that extends vertically in FIGS. 18, 19, and 20 may be described with reference to sides "A" and "B" as reflected in the figures.

Figure 20:
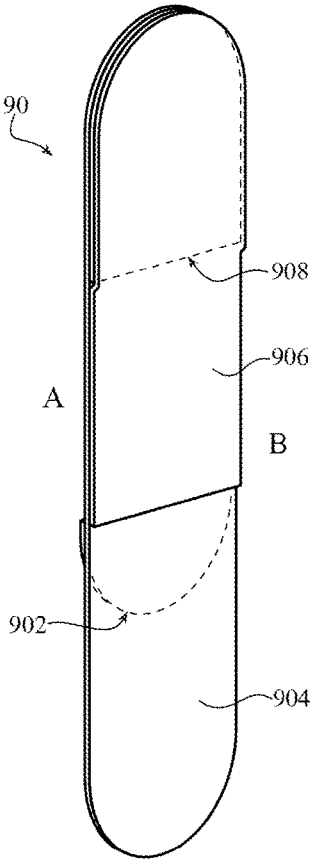
FIG. 20 shows a tamper-evident seal shown in FIG. 17 in a third assembled configuration.

When secured in a package, tamper-evident seal 90 may extend between a base box and a lid, similar to the other embodiments described herein. Because splittable adhesive 902 is initially fixed to the bottom of the base box, side B of paper substrate 904 is secured to the interior of a lid's sidewall. As indicated by the arrow in FIG. 19, as the user pulls down on a portion proximate the end of paper substrate 904 near splittable adhesive 902, the removable adhesive 908 may begin to detach from the lid by peeling away from the lid and reattach to side B of paper substrate 904. Turning to FIG. 20, a configuration where removable adhesive 908 is now between the first paper substrate 904 and second paper substrate 906. In this way, there is no tearing required of either paper substrate or tamper-evident seal 90. Additionally, because splittable adhesive 902 is no longer able to stick to other components, and removable adhesive 908 is reattached in a stuck between the first and second paper substrates, tamper-evident seal 90 is not able to be reattached to the packaging. In some embodiments, a layer of splittable adhesive 902 may be left on base box 10, such that it may include an indication such as a color or marker to indicate that the packaging has been opened.

As previously described, the base box may include a first side panel and a base panel. Lid 30 may include a second second side panel parallel to the first side panel and perpendicular to the base panel when the packaging is closed. Adhesive may couple a first paper substrate to the base panel, while a second adhesive couples a second paper substrate to the second side panel in a first configuration, e.g., a closed configuration. In response to a force applied in a direction away from the packaging, the first and second adhesive is configured to peel away from their respective panels, and wherein the second adhesive is configured to transition to be disposed between the first and second paper substrates.

Figure 21:
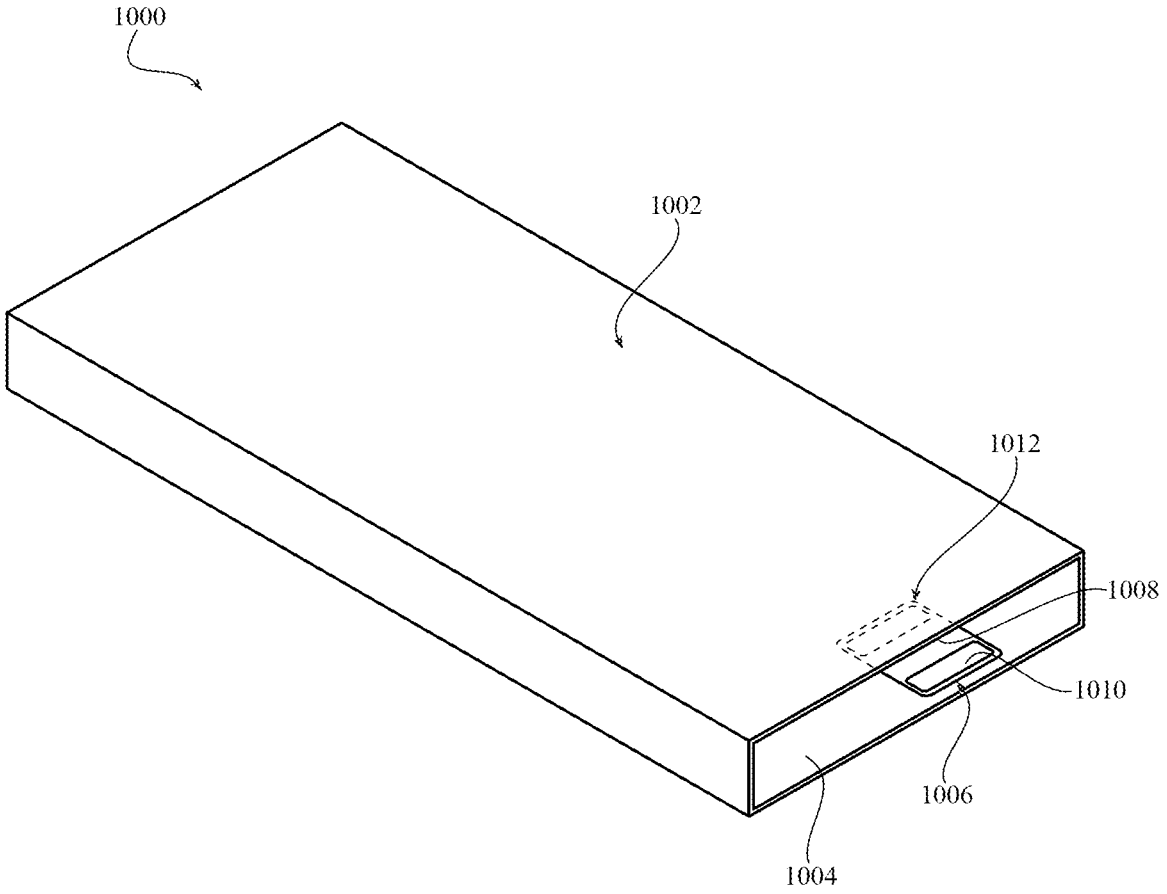
FIG. 21 shows a perspective view of a package with tamper-evident seal in an embodiment.

With reference to FIGS. 21 and 22-24, packaging 1000 is shown. In some embodiments, packaging 1000 includes a sleeve 1002 and a tray 1004 that may be received within sleeve 1002. As shown in FIG. 21, packaging 1000 is shown in a configuration after tamper-evident seal 1006 is broken but before tray 1004 is removed from sleeve 1002. Tray 1004 in turn may retain a product. As also shown, tamper-evident seal 1006 may be included. A portion of tamper-evident seal 1006 may be fixed to a portion of tray 1004. Panel 1008 of tamper-evident seal 1006 may include splittable adhesive 1010, such that prior to opening the packaging it may be fixed at the area shown in broken lines as element 1012. As with the splittable adhesive 902, splittable adhesive 1010 may include opposing outer surfaces that may be fixed to opposing substrates. In some embodiments, splittable adhesive 1010 may split, such that the surfaces fixed to the opposing substrates remain fixed to the respective substrates, while the splittable adhesive itself separates between its opposing outer surfaces, exposing non-adhesive inner surfaces. That is, once a splittable adhesive is in fact split, the newly-exposed inner surfaces, formerly interior to the splittable adhesive between its outer surfaces, do not re-adhere. In some embodiments of the splittable adhesive, once split, the formerly interior surface does not stick to other components.

Figure 22:
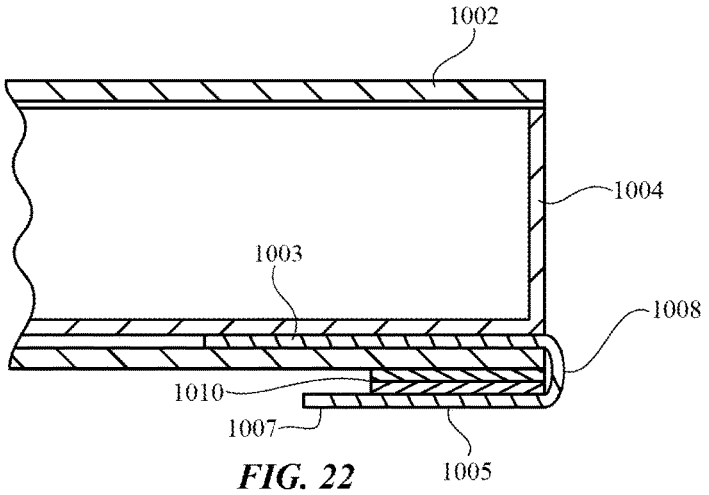
FIG. 22 shows a schematic side view of the package with tamper-evident seal shown in FIG. 21 in a first configuration.
Figure 23:
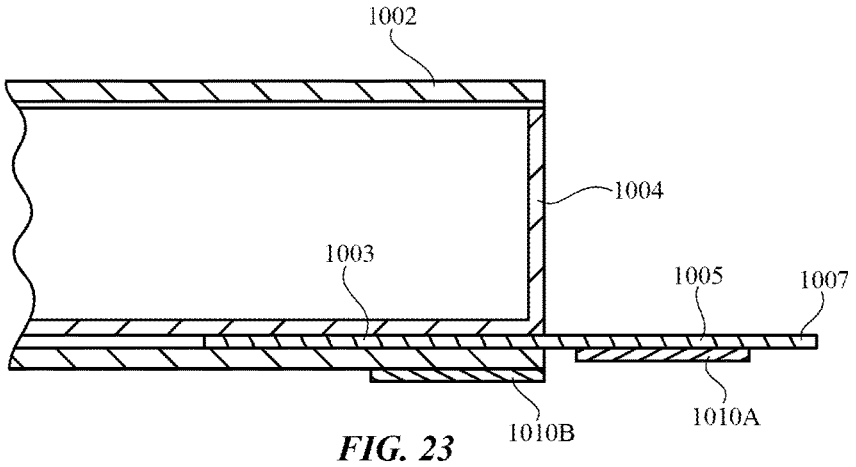
FIG. 23 shows a schematic side view of the package with tamper-evident seal shown in FIG. 21 in a second configuration.
Figure 24:
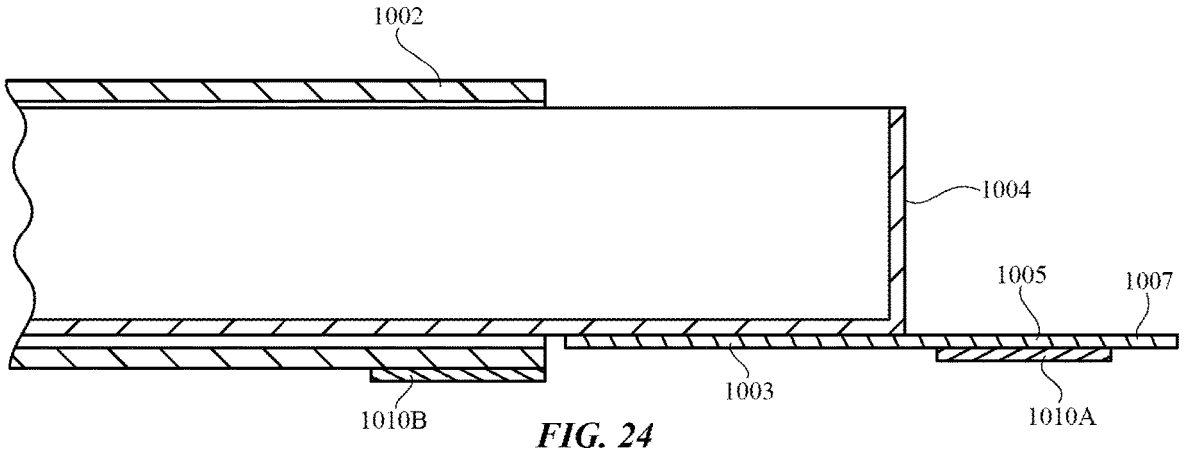
FIG. 24 shows a schematic side view of the package with tamper-evident seal shown in FIG. 21 in a third configuration.

FIGS. 22-24 show cross-sectional views through a closure portion of packaging 1000. FIG. 22 shows the closure portion as closed, e.g., tamper-evident seal 1006 being closed. FIG. 23 shows tamper evident seal 1006 being broken, and FIG. 24 shows the tray 1004 being removed, e.g., via tab 1007. As shown in the FIGS. 22-24, splittable adhesive 1010 may include two portions, e.g., 1010A and 1010B. Panel 1003 of tamper-evident seal 1006 may be fixed to tray 1004, such that tamper-evident seal 1006 may be used as a pull tab, pulling panel 1005, e.g. by splitting tab 1007 away such that splittable adhesive 1010 split. As used herein, "split" may include delamination. Because tamper-evident seal 1006 is fixed to tray 1004, and removably fixed to sleeve 1002 via splittable adhesive 1010, tamper-evident seal 1006 provides an indication that the packaging has been opened, if splittable adhesive 1010 is open (e.g., if portion 1010B is uncoupled from portion 1010A). In some embodiments, splittable adhesives used as described herein may include a separate indication of tampering. For example, a particular color, text, or other indicator may be included such that there is a visual indication, e.g., at one or more surfaces 1010A or 1010B that indicates the tamper-evident seal has been opened.

Figure 25:
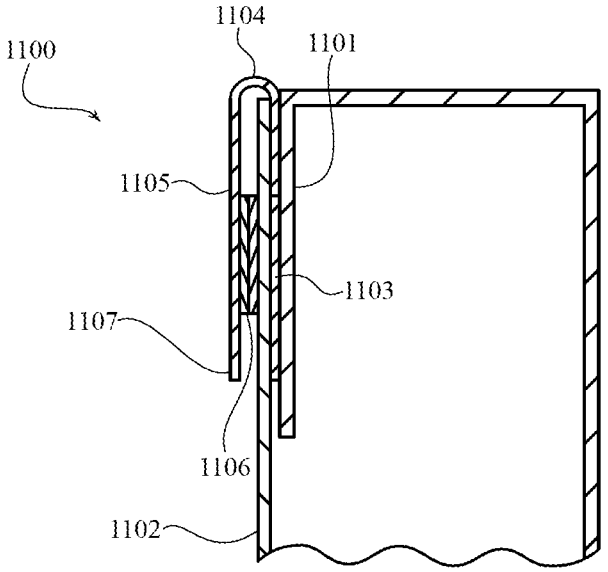
FIG. 25 shows a schematic side view of a package with tamper-evident seal in an embodiment.
Figure 26:
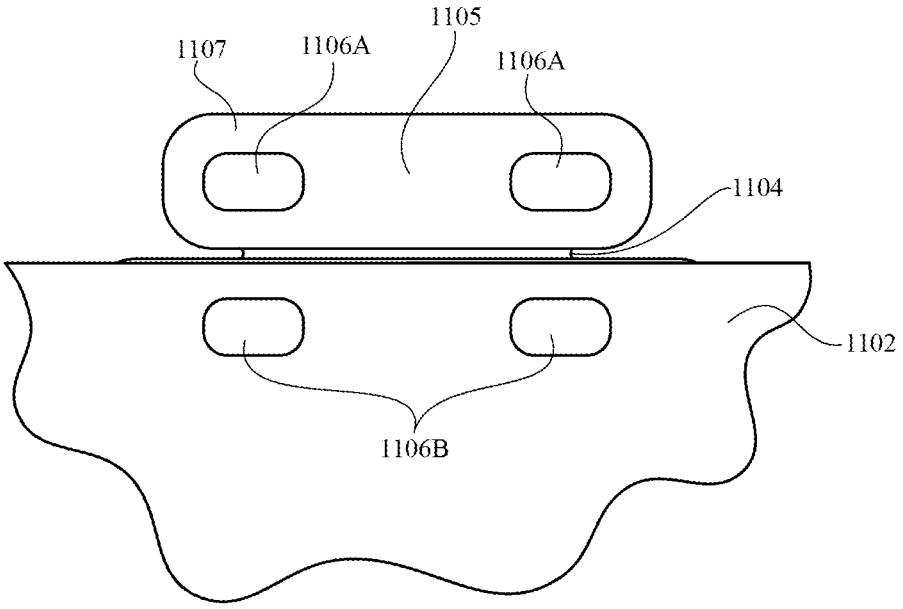
FIG. 26 shows a front view of the package with tamper-evident seal shown in FIG. 26.

Turning to FIGS. 25 and 26, a portion of packaging 1100 is shown, showing a closure element using tamper-evident seal 1104 to couple a first panel 1101 (e.g., a first portion such as a tuck flap) and a second panel 1102 (e.g., a second portion such as a lid panel). FIG. 25 shows a cross-sectional view through a closure portion of packaging 1100 in a closed configuration. FIG. 26 shows a front view of the closure portion of packaging 1100 in an open configuration. In some embodiments first and second panels 1101 and 1102, respectively may be formed from a unitary blank. As shown in the figure, first panel 1101 defines a partial volume with multiple side walls, and in a closed configuration second panel 1102 is coupled to first panel 1101 using tamper-evident seal 1104. Fixed panel 1103 of tamper-evident seal 1104 may be fixed to the first panel 1101 and be disposed between the first panel 1101 and second panel 1102 in a closed configuration, while panel 1105 of tamper-evident seal 1104 may be coupled at splittable adhesive 1106. In some embodiments, panel 1105 may be decoupled at splittable adhesive 1106, for example by pulling at tab 1107, in a manner similar to that of the other splittable adhesive discussions herein.

As shown in FIG. 26, splittable adhesive 1106 may be split into one or more surfaces 1106A and 1106B, such that the corresponding surfaces are detachably coupled to release second panel 1102 from first panel 1101. Because tamper-evident seal 1004 is fixed to first panel 1101, and removably fixed to second panel 1102, tamper-evident seal 1104 provides an indication that the packaging has been opened, if splittable adhesive 1106 is open. In some embodiments, splittable adhesives used as described herein may include a separate indication of tampering. For example, a particular color, text, or other indicator may be included such that there is a visual indication (e.g., at one or more surfaces 1106A or 1106B) that indicates the tamper-evident seal has been opened.

In some embodiments, the splittable adhesive 1106 may be replaced by a perforated indication system that may tear along the general outlines of the splittable adhesive as shown, such that the surfaces 1106A or 1106B are torn either through or with a separate material left behind on either portion 1102 or portion 1105, thereby indicating tampering.

Figure 27:
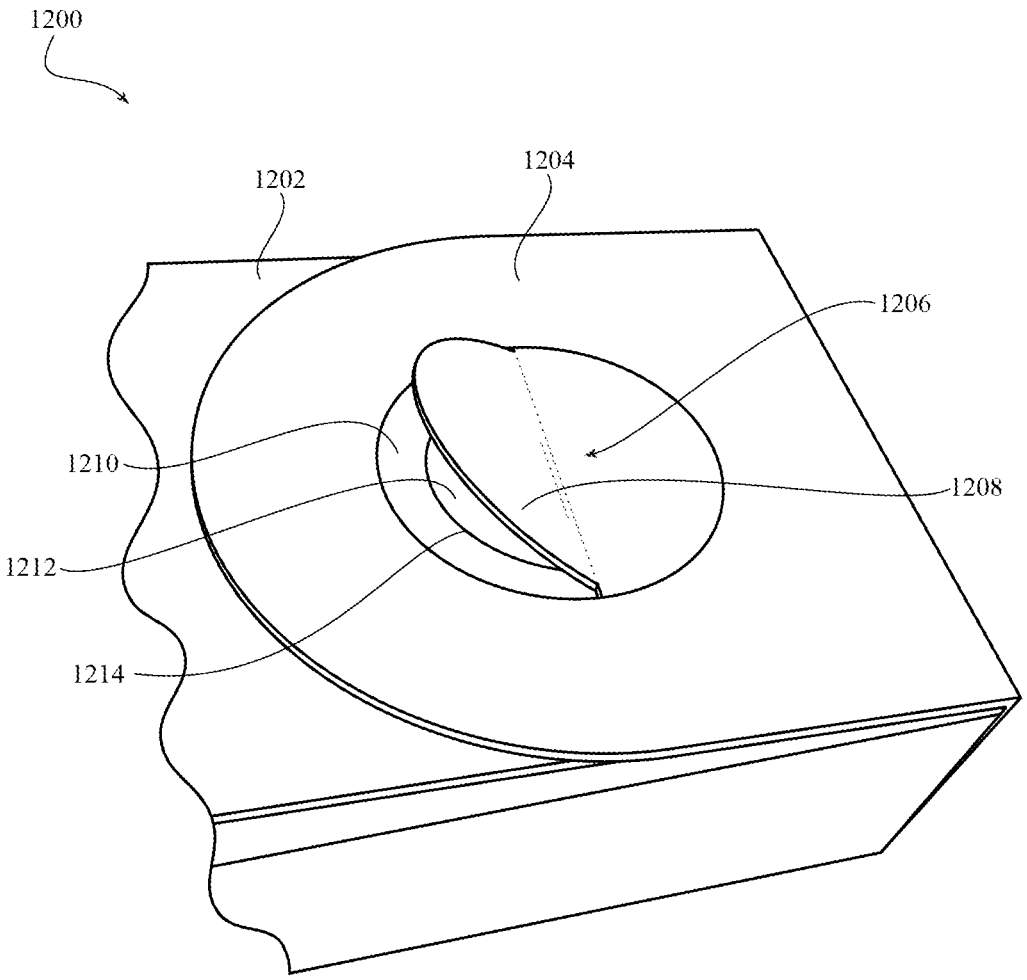
FIG. 27 shows a perspective view of a package with tamper-evident seal in an embodiment.

Finally, turning to FIG. 27, a portion of packaging 1200 is shown. Packaging 1200 may be of a folded design form, and include several folded components including panel 1204 that folds over panel 1202 to form a closed packaging configuration. Tab 1208 may extend from surface 1206 (which may be a part of panel 1204) such that in the closed configuration it is flush with surface 1210, and still connected to the perimeter of that portion. Perforations may be included, such that when the tab 1208 is pulled up, the portion tears such that the seal is broken, thereby evidencing that the seal has been opened, and allowing panel 1204 to fold up and away from panel 1202. In some embodiments, outline 1214 or surface 1212 may provide an indication (e.g., color, text, or the like) that the seal has been broken.

Each of the components may be composed of recyclable materials including the tamper-evident seals and related components. Thus, if and when the customer opts to dispose of the packaging, the packaging may simply be recycled without requiring material separation (e.g., in a single-stream recycling program). Advantageously, this improves upon prior systems having, for example, whole film encapsulation tamper-evident systems.

Components of the packaging described herein, such as base boxes 10, each of the tamper-evident seals, and lid 30, may be formed from one or more blanks, e.g., cardboard or paper blanks. In some embodiments, the blank is formed of a single continuous substrate, such as, for example cellulose-based material like cardboard corrugate. Other cellulose-based materials are contemplated, such as paperboard, certain molded fiber components of sufficient construction, or grayboard. Tabs, flaps, and regions without adhesive of the blank are folded such that no adhesive is visible in finished packaging. In some embodiments, adhesive may be omitted and the various flaps and tabs attached in another suitable manner (e.g., by mechanical interlock or press fit).

Each of the components and their constituent parts, and other variations described herein may include corresponding features described with reference to each of the other components and features described without limitation.

In some embodiments, any surface finishing may take place after the components are cut from the blank, or alternatively prior to the blank being cut into separate sheets for assembling to a final product. Additionally, some operations may be performed concurrently. All or some of the surfaces of the packaging may be coated, or laminated, which may increase structural strength properties such as rigidity and which may protect a product within the packaging, or avoid scratching.

Additionally, the packaging may be manufactured in a cost-effective and environmentally-friendly way. In some embodiments, the packaging components may be constructed of a single integrally-formed piece of material. The single integrally-formed piece of material may be a foldable material that is folded into a configuration that holds and secures a product, either alone or within a cavity of a packaging container. In some embodiments, the foldable material may be a single piece of material that is cut by a single operation (e.g., a single die-cutting operation). In some embodiments, the foldable material may be die cut from a stock material (e.g., a sheet of cardboard corrugate, or roll of material), or other fiber or cellulose based material. Single integrally-formed pieces of material that are cut by a single cutting operation may facilitate efficient and reproducible manufacturing. Moreover, such manufacturing may reduce waste by reducing waste material during manufacturing.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A tamper-evident seal for packaging, comprising:

a paper substrate comprising:

a first adhesive portion configured to attach to a side panel of a base box;

a second adhesive portion configured to attach to a second side panel of a lid, wherein the first and second adhesive portions are disposed on opposite surfaces of the paper substrate and are positioned between the side panel of the base box and the second side panel of the lid; and a tab configured to be accessible on an exterior of a package when the tamper-evident seal is applied, wherein when the tab is pulled with sufficient force, the paper substrate tears such that the first adhesive portion and the second adhesive portion remain fixed to the first and second side panels, respectively, while the remainder of the paper substrate tears free so that the packaging may be opened.

2. The packaging of claim 1, wherein one of the first adhesive portions or the second adhesive portions comprises fiber tape.

3. The packaging of claim 1, wherein the first adhesive portion and the second adhesive portion extend in opposite directions from the tab, thereby forming a T-shape.

4. The packaging of claim 1, wherein the paper substrate is configured to tear to create tear paths extending along the direction of the pull force.

5. The packaging of claim 1, wherein the tab is releasably attached to the base or lid when the base box and lid are in the closed configuration.

6. Packaging, comprising:

a base box comprising a first side panel;

a lid comprising a second side panel parallel to the first side panel; and a tamper-evident seal disposed between the first and second side panels when the base box and lid are in a closed configuration, the tamper-evident seal comprising:

a paper substrate comprising:

a first portion extending in a first direction;

second and third portions extending in opposing directions, wherein the first, second, and third portions together form a T-shape, wherein the first portion is folded over onto itself at a first fold, and wherein the second and third portions are each respectively folded at second and third folds around a portion of the overlap of the first portion formed by the fold;

a first adhesive portion attached to the first side panel;

a second adhesive portion attached to the second side panel, wherein, in response to a force applied in a direction away from the packaging, the paper substrate is configured to tear such that the first portion tears free along a first and second line parallel to the folds of the second and third portions.

7. The packaging of claim 6, wherein one of the first or second adhesive portions comprises fiber tape.

8. The packaging of claim 6, wherein the first adhesive portion is attached to a surface of the first side panel that is facing the second side panel, and wherein the second adhesive portion is attached to a surface of the second side panel that is facing the first side panel.

9. The packaging of claim 6, the base box further comprising:

an indentation to receive a portion of the tamper-evident seal on the outside of the base box, wherein the first portion of the paper substrate further comprises a releasable adhesive to engage the indentation when the packaging is in a closed configuration.

10. The packaging of claim 6, wherein the paper substrate further comprises a tab extending from the first portion, wherein the tab is releasably attached to the base or lid when the base box and lid are in the closed configuration.

11. The packaging of claim 6, wherein the paper substrate includes stress concentration features at an intersection point of the first and second and first and third portions, respectively.

12. The packaging of claim 6, wherein the tamper-evident seal further comprises:

a stiffening element fixed to the first portion of the paper substrate and configured to increase stiffness of the first portion relative to one of the second or third portions.

13. The packaging of claim 6, wherein widths of the individual portions of the paper substrate are equal.

14. The packaging of claim 6, wherein the paper substrate further comprises a tab extending from the first portion, the tab having an increased width relative to the first portion, and wherein the width of the second and third portions are equal to each other.

15. The packaging of claim 6, wherein the first portion of the paper substrate further comprises a releasable adhesive to engage one of the base box or the lid when packaging is in a closed configuration, prior to tearing the tamper-evident seal.

16. Packaging, comprising:

a base box comprising a first side panel and a base panel;

a lid comprising a second side panel parallel to the first side panel and perpendicular to the base panel when the packaging is closed; and a seal disposed between the first and second side panels when the base box and lid are in a closed configuration, the seal comprising:

a paper substrate;

a first adhesive coupling the paper substrate to the base panel;

a second adhesive coupling the paper substrate to the second side panel, wherein, in response to a force applied in a direction away from the packaging, the first and second adhesive is configured to peel away from their respective panels.

17. The packaging of claim 16, wherein the paper substrate does not tear during removal from the packaging.

18. The packaging of claim 16, the seal further comprising:

a third adhesive coupling the paper substrate to the second side panel having a stronger shear strength than the second adhesive in order for the seal to be removed from the packaging.

19. The packaging of claim 16, wherein the paper substrate is not attached to the first side panel.

20. The packaging of claim 16, wherein the paper substrate extends along the base panel, folding inward and along the first side panel, and doubles back on itself such that the second adhesive may be coupled to the second side panel.

* * * * *